United States Patent [19]

Knox et al.

[11] 4,275,974

[45] Jun. 30, 1981

[54] INFLATION AND GROUT SYSTEM

[75] Inventors: Lloyd C. Knox; Bob L. Sullaway, both of Duncan, Okla.

[73] Assignee: Halliburton Company, Duncan, Okla.

[21] Appl. No.: 12,674

[22] Filed: Feb. 15, 1979

[51] Int. Cl.[3] ..... E02B 17/00

[52] U.S. Cl. ..... 405/225; 405/227

[58] Field of Search ..... 405/195, 223, 224, 225, 405/227

[56] References Cited

U.S. PATENT DOCUMENTS

| | | | |
|---|---|---|---|
| 3,468,132 | 9/1969 | Harris | 405/211 |
| 3,878,687 | 4/1975 | Tragesser | 405/227 X |
| 4,009,581 | 3/1977 | Britton et al. | 405/227 |
| 4,047,391 | 9/1977 | Mayfield et al. | 405/225 |
| 4,052,861 | 10/1977 | Malone et al. | 405/195 |
| 4,063,421 | 12/1977 | Coone et al. | 405/225 |
| 4,063,427 | 12/1977 | Hoffman | 405/225 |
| 4,077,224 | 3/1978 | Coone | 405/225 |
| 4,140,426 | 2/1979 | Knox | 405/225 |
| 4,171,923 | 10/1979 | Landers | 405/225 |
| 4,184,790 | 1/1980 | Bassett | 405/225 |

*Primary Examiner*—David H. Corbin

*Attorney, Agent, or Firm*—John H. Tregoning; James R. Duzan

[57] ABSTRACT

A system for inflating packers installed in offshore platforms and grouting the annuli between the piles and either the jacket legs and/or pile sleeves utilizing a separate inflation line system for the packers and a separate grouting line system for grouting the annuli.

71 Claims, 9 Drawing Figures

INFLATION AND GROUT SYSTEM

This application is related to U.S. Pat. No. 4,140,426 filed Oct. 21, 1977 and issued Feb. 20, 1979.

This invention relates to a system for inflating packers installed in offshore platforms and grouting the annuli between the piles and either the jacket legs and/or pile sleeves utilizing a separate inflation line system for the packers and a separate grouting line system for grouting the annuli.

As offshore platforms are required to be designed for use in greater depths of the ocean it has become necessary to install pile sleeves about the jacket legs to provide additional anchoring of the offshore platform to the ocean floor. To seal the annulus between the pile, which has been driven to the desired depth in the ocean floor, and the pile sleeve for grouting two inflatable packers are installed in each pile sleeve, one packer being located at the top of the pile sleeve while the other packer is located adjacent the bottom of the pile sleeve, or occassionally only one inflatable packer may be installed in the pile sleeve at the bottom thereof.

In the past, a separate inflation line has been used for each packer of the packers installed in each pile sleeve and a separate grout injection line has been used for injecting grouting into the annulus between the pile and pile sleeve as well as a separate grout return line being used for returning excess grouting material to the top of the offshore platform from each pile sleeve. For example, an offshore platform having sixteen pile sleeves would have thirty-two packers installed in the pile sleeves to seal the annuli between the pile and pile sleeves thereby requiring thirty-two packer inflation lines, sixteen grout injection lines and sixteen grout return lines, all of which must run to the top of the platform.

Alternatively, if only one packer was used at the bottom of each pile sleeve and the grout allowed to flow out the top of the pile sleeve rather than being returned to the surface or top of the platform, sixteen packer inflation lines would be required and sixteen grout lines would be required. Such a grouting system is shown in FIG. 5 of U.S. Pat. No. 4,063,421.

Another type of grouting arrangement that has been used to inflate the packers installed on a pile sleeve and grout the annulus between the pile sleeve and the pile is a single line packer inflation and annulus grouting arrangement. Typically, in such an arrangement, a single line is installed to each pile sleeve to supply the inflation fluid to the packer installed at the bottom of the pile sleeve and grouting material to the annulus between the pile and pile sleeve. Such a grouting system is shown in U.S. Pat. No. 4,063,421 and U.S. Pat. No. 4,063,427. However, such grouting systems do not offer an integrated system for inflating more than one packer on a pile sleeve or for inflating any number of packers installed on an offshore platform. Similarly, such systems also do not include any provisions for the circulation of grouting materials to the surface from the annulus between the pile and pile sleeve and for maintaining the packer inflation fluid separate from the grouting material.

In contrast to the prior art, the present invention comprises a system and method for the inflation of multiple packers installed upon one or more jacket legs and/or pile sleeves of an offshore platform by means of a packer inflation system and the grouting of the annuli between the piles and either the jacket legs and/or pile sleeves of the offshore platform by means of a separate grouting system.

Figure 1:
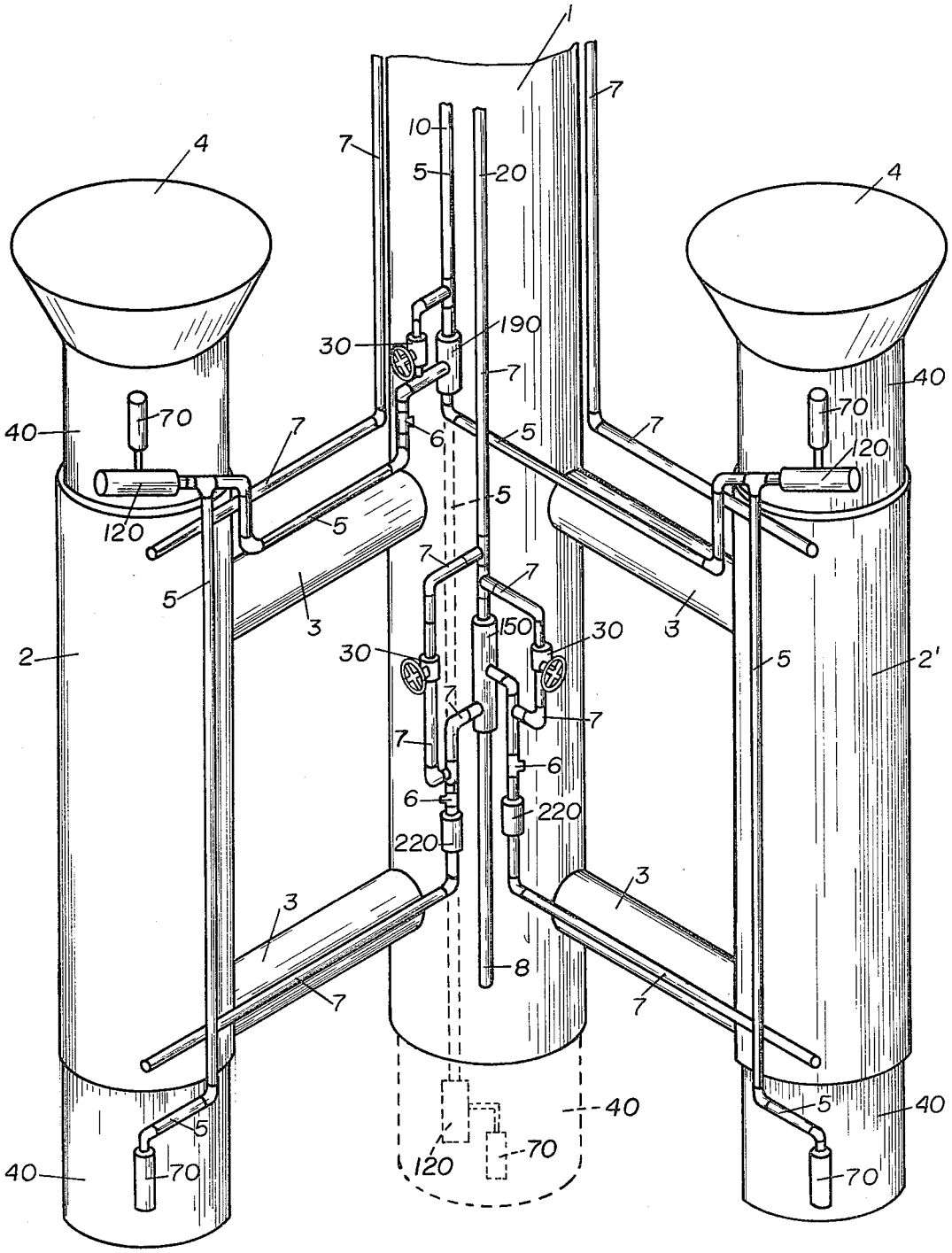
FIG. 1 is a view of the present invention installed on the jacket leg and pile sleeves of an offshore platform.

Referring to FIG. 1 the preferred embodiment of the present invention is shown.

The jacket leg 1 of an offshore platform is shown having pile sleeves 2 and 2' connected to the lower end of the jacket leg 1 by means of cross members 3.

The pile sleeves 2 and 2' have inflatable packers 40 installed at the upper and lower ends thereof. Secured to the upper end of the packers 40 which are installed on the upper ends of the pile sleeves 2 and 2' are pile guides 4 which serve to guide the piles (not shown) into the pile sleeves 2 and 2' during the insertion of the piles thereinto.

The inflation system 10 used for supplying inflation fluid or gas to the inflatable packers 40 comprises sliding sleeve type valve means 190, lower packer inflation check valve means 70, an upper packer inflation control valve means 120, an upper packer inflation check valve means 70, and a bypass valve means 30 which are interconnected with suitable fluid tight inflation lines 5. Also, installed in the inflation system 10 after the sliding sleeve type valve 190 and bypass valve 30 is a pipe tee and plug means 6, the function of which will be explained later.

The pile sleeve grouting system 20 used for supplying and returning grouting materials to the pile sleeves from the surface of the offshore platform to grout the annuli between the pile and pile sleeve comprises sliding sleeve type valve means 150, grout control check valve means 220 and bypass valve means 30 which are interconnected with suitable fluid tight grouting lines 7.

The jacket leg grouting system comprises a grouting line 8 which runs from the outlet of the sliding sleeve type valve means 150 to the bottom of the jacket leg 1.

As shown in phantom, an inflatable packer 40 having either a packer inflation check valve means 70 and/or packer inflation control valve means 120 may be installed on the jacket leg 1.

Figure 2:
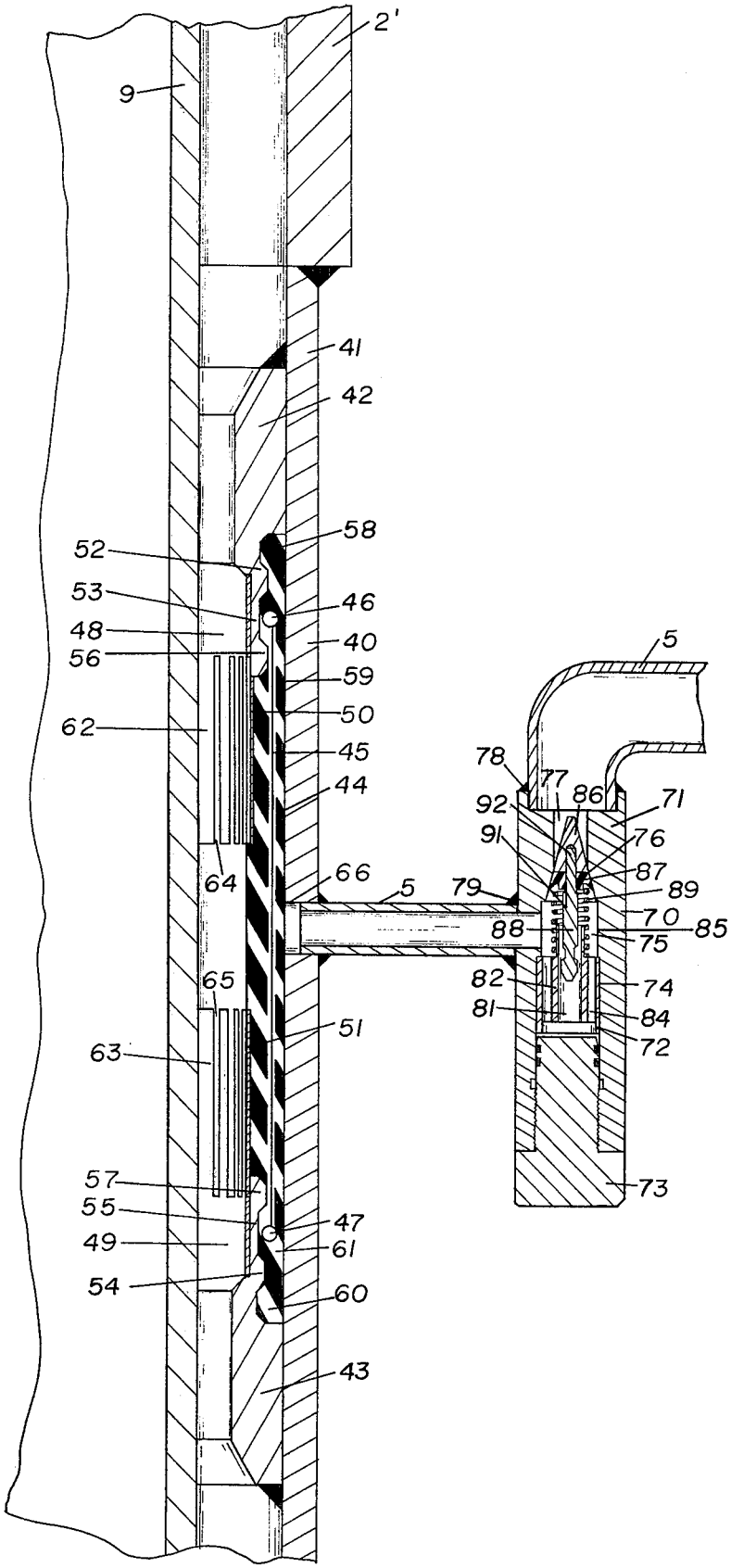
FIG. 2 is a cross-sectional view of a portion of the present invention showing a portion of an inflatable packer and a check valve assembly therefore which are installed on the lower end of a pile sleeve of a offshore platform.

Referring to FIG. 2, the inflatable packer 40 installed at the lower end of the pile sleeve 2 or 2' and the lower packer inflation check valve means 70 are illustrated. The pile sleeve 2' and the inflatable packer 40 installed at the lower end thereof are shown having a pile 9 inserted therethrough.

As shown in FIG. 2, the inflatable packer 40, shown in its preferred embodiment, comprises a packer housing 41, guide rings 42 and 43, an elastomeric packer member 44 and packer member back-up shoes 48 and 49. The packer housing 41 is cylindrical and made in any convenient diameter to match the pile sleeve 2' to which it is welded, as shown.

The guide ring 42 is welded to the packer housing 41 to secure one end of the packer member 44 within the packer housing 41 from any axial movement within the packer housing 41. The guide ring 42 is formed with a reduced thickness portion having two annular channels 52 and 53 which mate with the annular beads 58 and 59 respectively on one end of the packer member 44. The guide rng 42 further includes annular bead 56 which prevents the withdrawal of annular bead 59 of packer member 44 from annular channel 53.

Similarly, guide ring 43 is welded to the packer housing 41 to secure the other end of the packer member 44 within the packer housing 41 from any axial movement within the packer housing 41. The guide ring 43 is formed with a reduced thickness portion having two anular channels 54 and 55 which mate with annular beads 60 and 61 respectively on the other end of packer member 44. The guide ring 43 further includes annular bead 57 which prevents the withdrawal of annular bead 61 of packer member 44 from annular channel 55.

The packer member 44 can be formed of any suitable elastomeric material, although rubber is preferred. The packer member 44 has an annular reinforcing member 45 which is anchored about one end by an annular metal ring 46 contained in annular bead 59 located on one end of the packer member 44 while the other end of reinforcing member 45 is anchored about annular metal ring 47 contained in annular bead 61 located on the other end of the packer member 44. The reinforcing member 45 can be of any suitable material, although a fabric of nylon is preferred. The annular metal rings 46 and 47 may be either solid steel or twisted steel cable. The packer member 44 further comprises an annular band of material 50 located adjacent one end of the packer member 44 on the inner diameter thereof which underlies the fingers 62 of back-up shoe 48 while an annular band of material 51 located adjacent the other end of the packer member 44 on the inner diameter thereof underlies the fingers 63 of back-up shoe 49. The annular bands 50 and 51 of the material serve to protect the packer member 44 from damage by the fingers 62 and 63 of the back-up shoes 48 and 49 respectively when the packer element is being inflated and to prevent the flow of rubber into the slots 64 and 65 when the packer member 44 is being formed. The annular bands 50 and 51 may be formed of any suitable flexible material which has sufficient strength to protect packer member 44, such as steel, brass, etc., although a fabric of nylon is preferred.

The back-up shoe 48 is an annular metal band having fingers 62 separated by spaces 64 and is located on the inner diameter of the packer member 44 adjacent one end thereof. Similarly the back-up shoe 49 is an annular metal band having fingers 63 separated by spaces 65 and is located on the inner diameter of the packer member 44 adjacent the other end thereof. The back-up shoes 48 and 49 may be formed of any suitable metal, although steel is preferred. The back-up shoes 48 and 49 initially protect the packer element 44 from being damaged by the pile 9 while the pile is being driven therethrough since the back-up shoes 48 and 49 hold the packer member 44 against the packer housing 41 until the packer member 44 is inflated.

Although the inflatable packer 40 described hereinabove is the preferred packer for use with the inflation system 10, any suitable inflatable packers, such as those described in U.S. Pat. Nos. 4,052,861; 4,047,391 and 3,468,132 may be used.

As further shown in FIG. 2, the lower packer inflation check valve means 70 is connected to the inlet port 66 of the inflatable packer 40 by means of inflation fluid line 5. The lower packer inflation check valve means 70 comprises a housing, a valve body and a valve body return spring.

The check valve housing comprises a first member 71 which engages the plug portion of the valve body, a second member 72 which engages the stem portion of the valve body and an end cap 73. The first member 71 is formed with a bore 74 to accept a portion of the second member 72, a bore 75 which communicates with inflation fluid line 5, a conical bore 76 which engages the plug portion of the valve body and a bore 77 which communicates with inflation fluid line 5. The first member is connected to the inflation fluid line 5 at 78 by means of welding. Similarly, the first member 71 is connected at 79 to inflation fluid line 5 leading to inflatable packer 40 by means of welding. Although the first member has been shown connected to inflation fluid lines 5 by means of welding, any suitable type fastening means may be used.

The second member 72 comprises a central bore 81 having a valve body guide 82 and a plurality of bores 84 which provide communication between the cavity formed by bore 75 in the first member 71 and the cavity formed by bore 85 in the second member 72. The end of the second member 72 is sealed by a cap 73 secured to the first member 71 by any convenient means.

The valve body contained within the housing formed by the first member 71, second member 72 and end cap 73 comprises a valve body cap 86, resilient valve body seal 87, valve body stem 88 and valve body spring 89. The valve body stem 88 is formed with one end having the resilient valve body seal 87 being held in position against annular shoulder 91 by the valve body cap 86 threadedly engaging the end 92 of the valve body stem 88. Although the valve body cap 86 has been shown as being threadedly secured to the valve body stem 88, any suitable fastening means may be used. Additionally, the resilient valve body seal 87 may be formed of any suitable elastomeric material.

As shown, the resilient valve body seal 87 and valve body cap 86 are biased into engagement with the conical bore 76 of the first member 71 of the check valve housing by means of the valve body spring 89.

A valve guard, not shown, may be provided to protect the lower packer check valve means 70 and inflation line 5 leading therefrom to the lower inflatable packer 40 installed on the pile sleeve 2' from damage during offshore platform handling operations.

Figure 3:
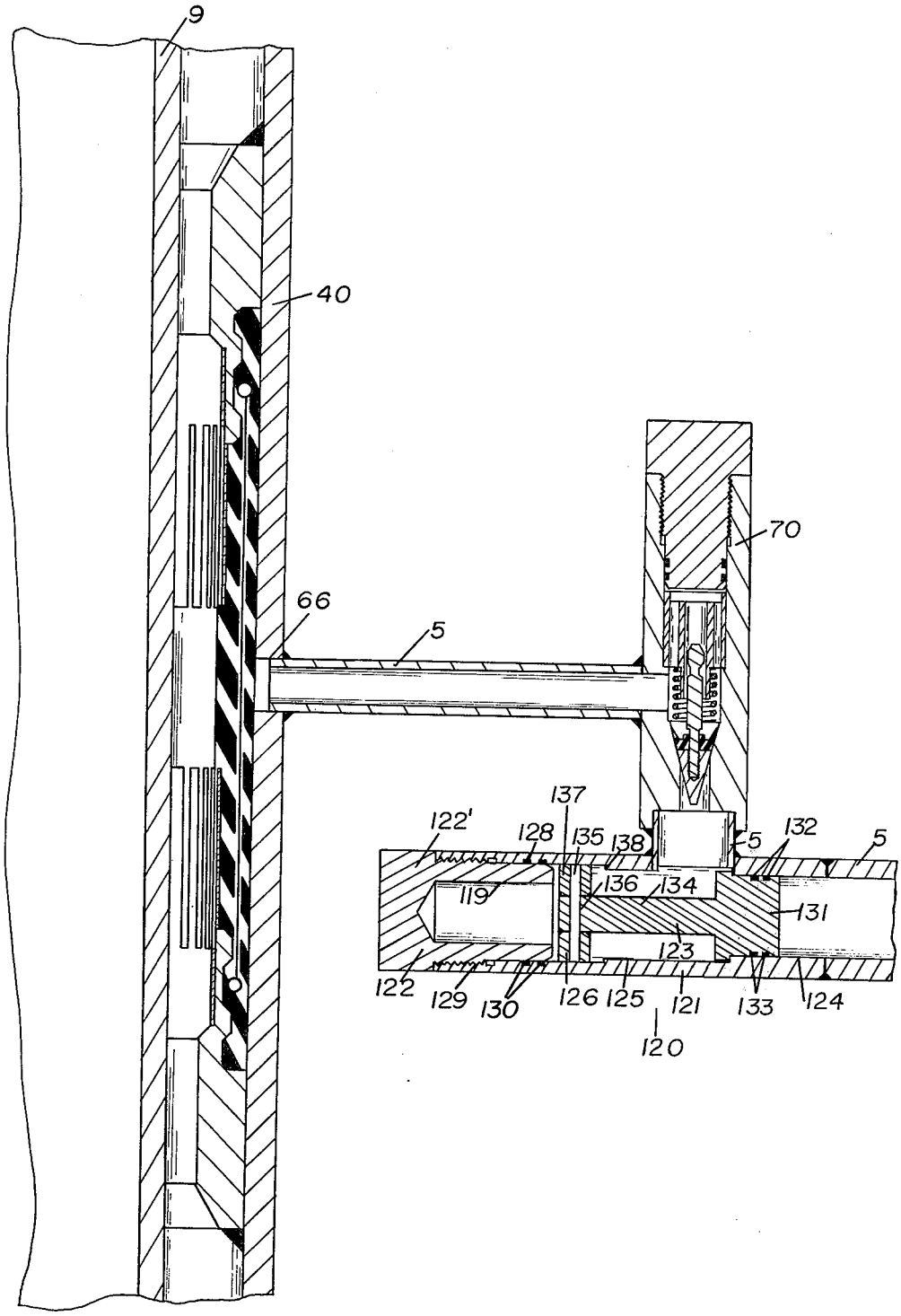
FIG. 3 is a cross-sectional view of a portion of the present invention showing a portion of an inflatable packer and inflation control valve assembly and check valve assembly thereforewhich are installed on the upper end of a pile sleeve of an offshore platform.

Referring to FIG. 3, the upper inflatable packer 40 and its associated upper packer inflation check valve means 70 and upper packer inflation control valve means 120 are shown. The upper packer inflation check valve means 70 and upper packer inflation control valve means 120 are installed in inflation line 5 and connected to inflation port 66 of the packer 40. A valve guard (not shown) may be provided to protect the upper packer inflation check valve means 70 and upper packer inflation control valve means 120 from damage during handling operation of the offshore platform.

The construction of the upper inflatable packer 40 and the upper packer inflation check valve means 70 are identical to the construction of the lower inflatable packer 40 and lower inflation check valve means 70 as shown in FIG. 2.

The upper packer inflation control valve means 120 comprises an inflation control valve housing 121, a inflation control valve cap 122 and an inflation control valve body 123.

The inflation control valve housing 121 is formed with a bore 124 which communicates with inflation line 5 and receives head 131 of the inflation control valve 123, bore 125 which communicates with inflation line 5 leading to the upper packer inflation check valve means 70, bore 126 receives the shear pin 135 of the inflation control valve body 123, annular grooves 128 which received annular seal means 130, and threaded bore 129 which threadedly engages the threaded portion 122' of the inflation control valve cap 122. To form a fluid tight seal between the inflation control valve cap 122 and the inflation control valve housing 121 and annular seal means 130 is disposed in each annular groove 128. The annular seal means 130 may be of any suitable material, although an elastomeric O-ring is the preferred seal means. The inflation line 5 may be secured to the inflation control valve housing by any suitable means, although welding is preferred.

The inflation control valve plug body 123 comprises a head portion 131 having annular grooves 132 containing annular seal means 133 which sealingly engage bore 124 of the inflation control valve housing 121, a stem portion 134 and a shear pin 135 installed in an aperture 136 in the end of stem portion 134. The shear pin 135 is held in position in the inflation control valve housing 121 by means of washers 137 which are, in turn, held in position by the inflation control valve cap 122 forcing one of the washers in abutment with shoulder 138 in the inflation control valve housing 121. The washers 137 have a central aperture of sufficient size to allow the stem portion 134 of the inflation control valve plug body 123 to freely slide therethrough upon shearing of the shear pin 135. Also, the valve cap 122 is formed having blind bore 119 therein to receive stem portion 134 of the inflation control valve plug body 123 upon shearing of the shear pin 135.

A valve guard, not shown, may be provided to protect the upper packer inflation control valve means 120 and upper packer inflation check valve means 70 from damage during offshore platform handling operations.

Figure 4:
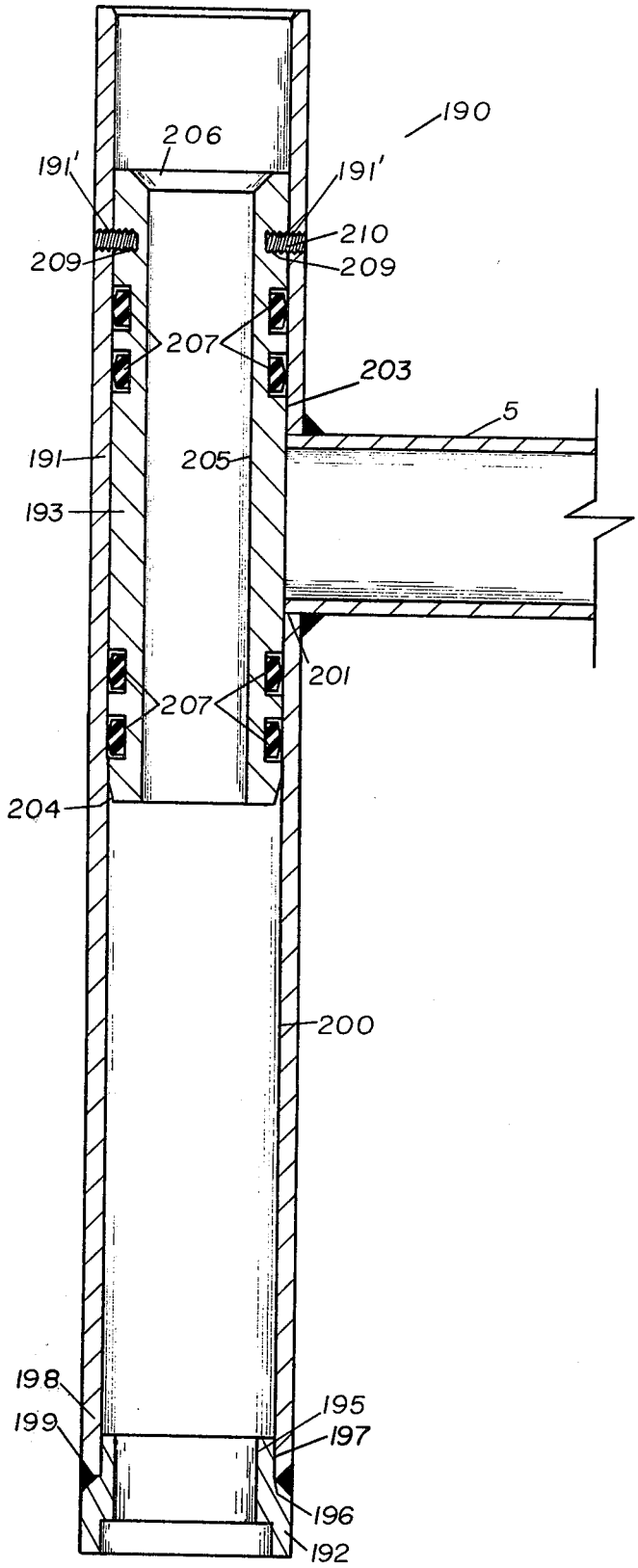
FIG. 4 is a cross-sectional view of a portion of the present invention showing a single sleeve sliding sleeve type valve.

Referring to FIG. 4, the sliding sleeve type valve means 190 is shown. The sleeve valve means 190 comprises a housing and a sliding sleeve 193.

The sleeve valve housing comprises a first member 191 containing the sliding sleeve 193 and a second member 192 which serves as a stop for the sliding sleeve 193. The first member 191 is secured to the inflation line 5 by any convenient means, although welding is preferred. The second member 192 is secured to the first member 191 and the inflation line 5 (not shown) by any suitable means, although welding is preferred.

As shown, the second member 192 is formed with a bore 195 which communicates with inflation line 5, a shoulder 196 which serves as an abutment for first member 191 and sleeve 193, and cylindrical exterior surface 197 which acts as a pilot when receiving the end of the first member 191. The first member 191 is formed with a portion 198 which is retained on cylindrical exterior surface 197 of the second member, chamfered surface 199 which facilitates welding of the first member to the second member 192 and a bore 200 in which the sleeve 193 slides, and a port 201 associated with the sleeve 193 which communicates with inflation line 5. The inflation lines 5 may be secured to the first member 191 of the housing by any suitable means, although welding is preferred. Also located in the side wall of the first member 191 are threaded bores 191' which receive shear pins 210 therein.

The sleeve 193 is formed with a bore 205, a lower chamfer 204, a bore 205, an upper chamfer 206, a plurality of annular grooves 207 each containing an elastomeric sealing means such as an elastomeric O-ring or elastomeric ring being rectangular in cross-sectional configuration and threaded bores 209 located in the sidewall of the sleeve 193.

The sleeve 193 is held in position in the first member 191 of the sleeve valve housing by means of shear pins 210 threadedly engaging threaded bores 191' in the first member 191 and threaded bores 209 in the sleeve 193. When held in position within the first member 191 of the sleeve valve housing, the sleeve 193 blocks the port 201 to prevent the flow of fluid therethrough.

Figure 5:
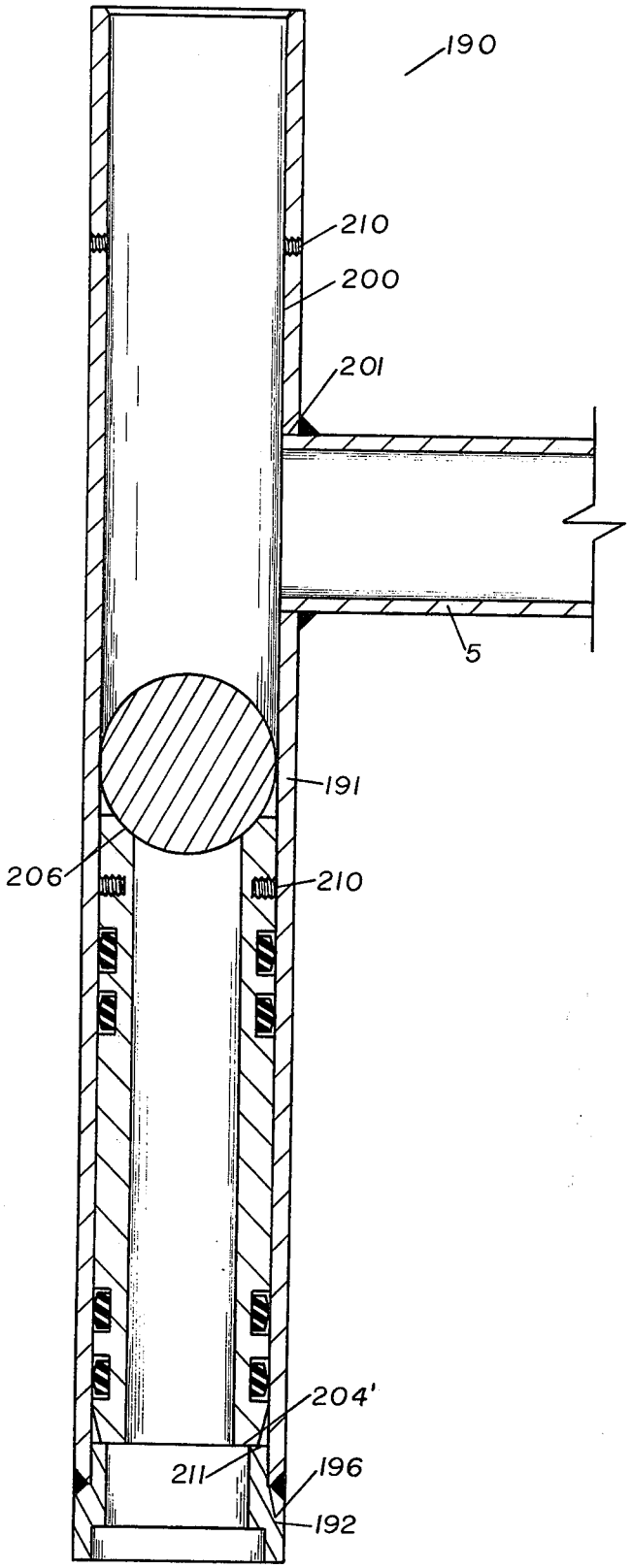
FIG. 5 is a cross-sectional view of a portion of the present invention showing the single sleeve sliding sleeve type valve of FIG. 4 in its actuated position.

Referring to FIG. 5, to open port 201 to fluid flow a ball, which is slightly smaller than bore 200 in the first member 191, is inserted in inflation line 5 and pumped or allowed to free fall therethrough until it seats on chamfer 206 of the sleeve 193. When the ball has seated on chamfer 206, the pressure in inflation line 5 is increased until the shear pin 210 is sheared thereby freeing sleeve 193 to move downwardly under the inflation liquid or gas pressure until the lower surface 204' abuts shoulder 196 of the second member 192 of the sleeve valve housing. When the sleeve 193 has surface 204' abutting shoulder 211 of the second member 192 of the sleeve valve housing, flow through the sleeve 193 is stopped by the ball sealingly engaging chamfer 206. Any subsequent flow is directed through open port 201 and through inflation line 5.

Although the sliding sleeve type valve means 190 has been illustrated having only one sliding sleeve and one outlet port, the valve means could be formed with any number of sleeves and outlet ports providing that the additional sleeves are of progressively smaller diameter than the last sleeve so that they may be actuated by balls. Additionally, although a sleeve valve means is preferred, any commercially available valve means which can be actuated through the single inflation line 5 to supply inflation fluid to a plurality of pile sleeves or jacket legs may be used either singly or in series in the inflation system 10.

Figure 6:
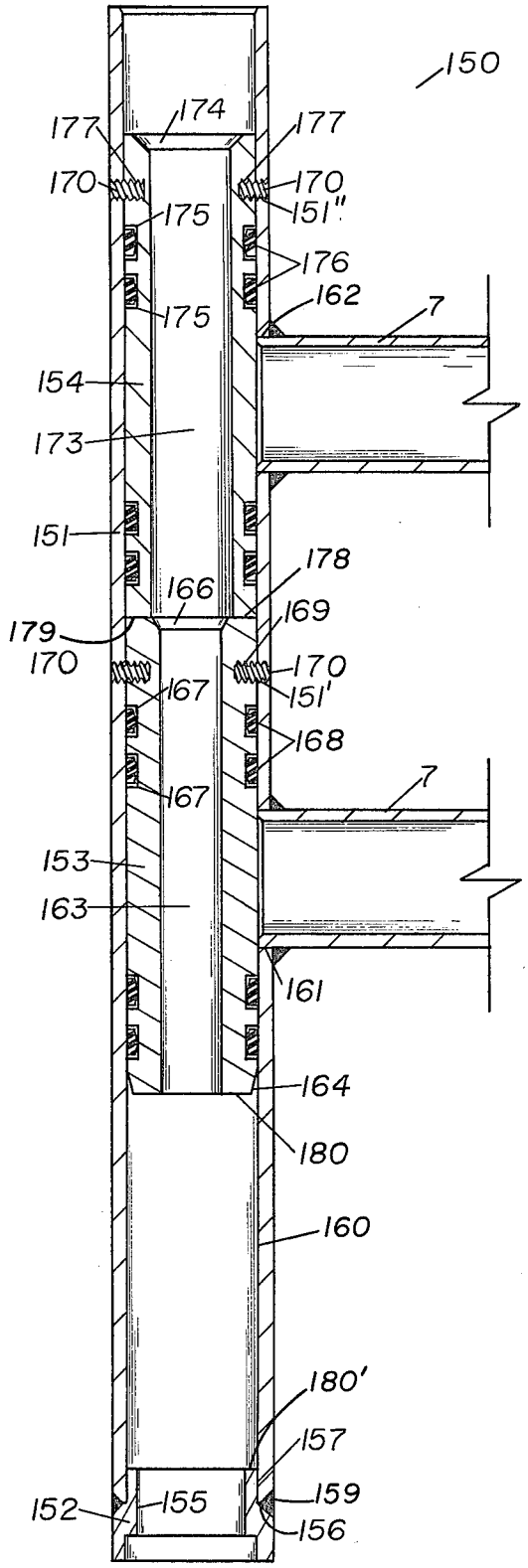
FIG. 6 is a cross-sectional view of a portion of the present invention showing a dual sleeve sliding sleeve type valve.

Referring to FIG. 6, the sliding sleeve type valve means 150 is shown. The sleeve valve means 150 comprises a housing, a first sliding sleeve 153 and a second sliding sleeve 154.

The sleeve valve housing comprises a first member 151 containing the first sliding sleeve 153 and second sliding sleeve 154 and a second member 152 which serves as a stop for the first sliding sleeve 153. The first member 151 is secured to the grout line 7 by any convenient means, although welding is preferred. The second member 152 is secured to the first member 151 and the grout line 7, not shown, by any suitable means, although welding is preferred.

As shown, the second member 152 is formed with a bore 155 which communicates with grout line 7, a shoulder 156 which serves as an abutment for first member 151 and a cylindrical exterior surface 157 which acts as a pilot when receiving the end of the first member 151. The first member 151 is retained on the cylindrical exterior surface 157 of second member 152, has a chamfer 159 which facilitates welding of the first member 151 to the second member 152 and has a bore 160 in which, the first sleeve 153 and second sleeve 154 slide, has a first port 161 associated with the first sleeve 153 and has a second port 162 associated with the second sleeve 154. The first port 161 communicates with a grout line 7 leading to one of the pile sleeves 2 to be grouted while the port 162 communicates with another grout line 7 leading to another pile sleeve 2 to be grouted. The grout lines 7 may be secured to the first member 151 of the housing by any suitable means, although welding is preferred. Also located in the side wall of the first member 151 between the first port 161 and second port 162, are threaded bores 151' which receive shear pins 170 while threaded bores 151'' are located in the side wall of the first member 151 above port 162 and also receives shear pins 170.

The first sleeve 153 is formed with a bore 163, an upper chamfer 166, a plurality of annular groove 167 each containing an elastomeric sealing means such as an elastomeric O-ring or elastomeric seal means having a rectangular cross-sectional shape 168 and a threaded bore 169 located in the sidewall of the first sleeve 153.

The first sleeve 153 is held in position in the first member 151 of the sleeve valve housing by means of shear pins 170 threadedly engaging threaded bore 151' in the first member 151 and threaded bore 169 in the first sleeve 153. When held in position whthin the first member 151 of the sleeve valve housing, the first sleeve 153 blocks the first port 161 to prevent the flow of fluid therethrough.

The second sleeve 154 is formed with a bore 173, an upper chamfer 174, a plurality of annular grooves 175 each having an elastomeric seal means 176 such as an elastomeric O-ring or elastomeric seal means having a rectangular cross-sectional shape contained therein, and threaded bores 177 located in the sidewall of the second sleeve 154. The second sleeve 154 is held in position in the first member 151 of the sleeve valve housing with the lower surface 178 of the second sleeve 154 abutting the upper surface 179 of the first sleeve by means of shear pins 170 threadedly engaging threaded bores 151'' in the first member 151 and threaded bores 177 in the second sleeve 154. When held in position within the first member 151 of the sleeve valve housing, the second sleeve blocks the second port 162 to prevent the flow of fluid therethrough.

Figure 7:
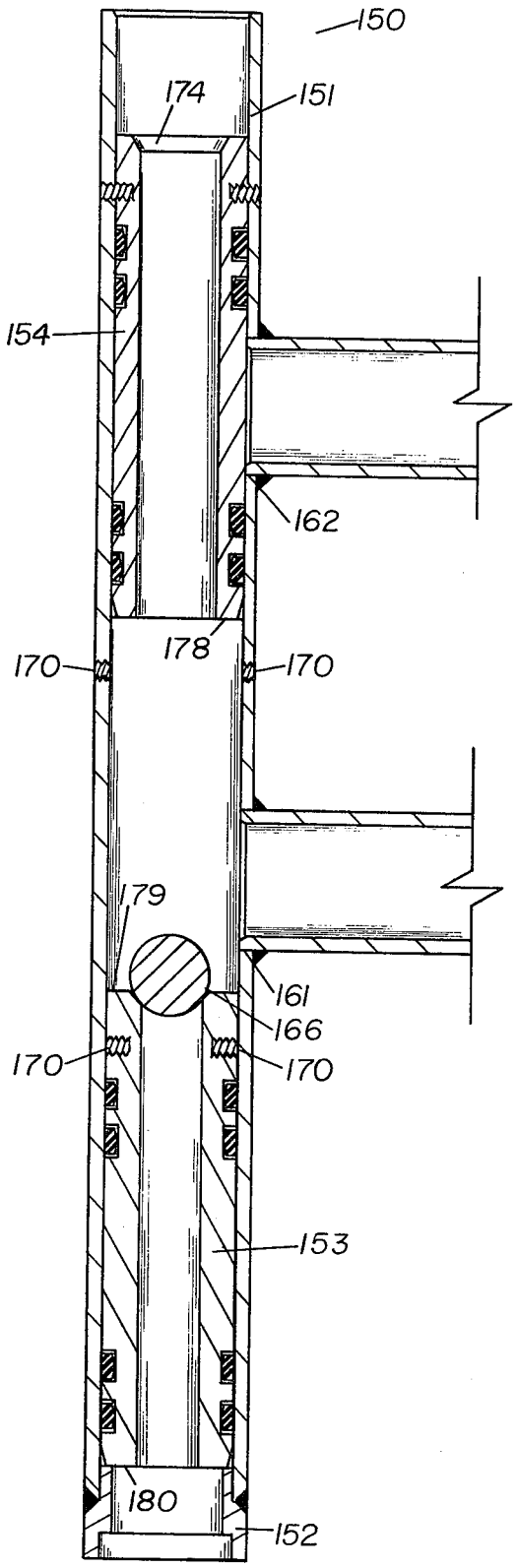
FIG. 7 is a cross-sectional view of a portion of the present invention showing the dual sleeve sliding sleeve type valve having one sleeve in an actuated position.

Referring to FIG. 7, to open port 161 to fluid flow a ball, which is slightly smaller than bore 173 in the second sleeve 154, is inserted in grout line 7 and pumped or allowed to free fall therethrough until it seats on chamfer 166 of the first sleeve 153. When the ball has seated on chamfer 166, the pressure in grout line 7 is increased until the shear pins 170 are sheared thereby freeing the first sleeve 153 to move downwardly in the first member 151 of the sleeve valve housing until lower surface 180 of the first sleeve 153 abuts shoulder 180' of the second member 152 of the sleeve valve housing. When the first sleeve 153 has surface 180 abutting shoulder 180' of the second member 152 of the sleeve valve housing, flow through the first sleeve 153 is stopped by the ball sealingly engaging chamfer 166. Any subsequent flow is directed through open port 161 and through grout line 7 connected thereto.

Although not illustrated, to open the port 162 communicating with grout line 7 connected thereto to the flow of fluid a ball slightly smaller in diameter than internal diameter of the grout line 7 leading to sliding sleeve type valve means 150 and the bore of first member 151 is inserted in grout line 7 and pumped or allowed to free fall therethrough until it seats on chamfer 174. When the ball has seated on chamfer 174, the pressure in grout line 7 is increased until the shear pins 170 are sheared thereby freeing the second sleeve 154 to move downwardly in the first member 151 of the sleeve valve housing until the lower surface 178 abuts the upper surface 179 of the first sleeve 153, at which time the port 162 in the first member 151 of the sleeve valve housing is uncovered and port 161 is sealed by the second sleeve 154.

When the second sleeve 154 has surface 178 abutting upper surface 179 of the first sleeve 153, flow through the second sleeve 154 is stopped by the ball sealingly engaging chamfer 174. Any subsequent flow is directed through open port 162 and through grout line 7 connected therethrough.

Although the sliding sleeve type valve means 150 has been illustrated having only two sliding sleeves and two outlet ports, the sleeve valve means could be formed with any number of sleeves and outlet ports to supply grout to any number of pile sleeves to be grouted. Additionally, although a sleeve valve means is preferred, any commercially available valve means which can be actuated to supply grout to a plurality of pile sleeves may be used either singly or in series.

Figure 8:
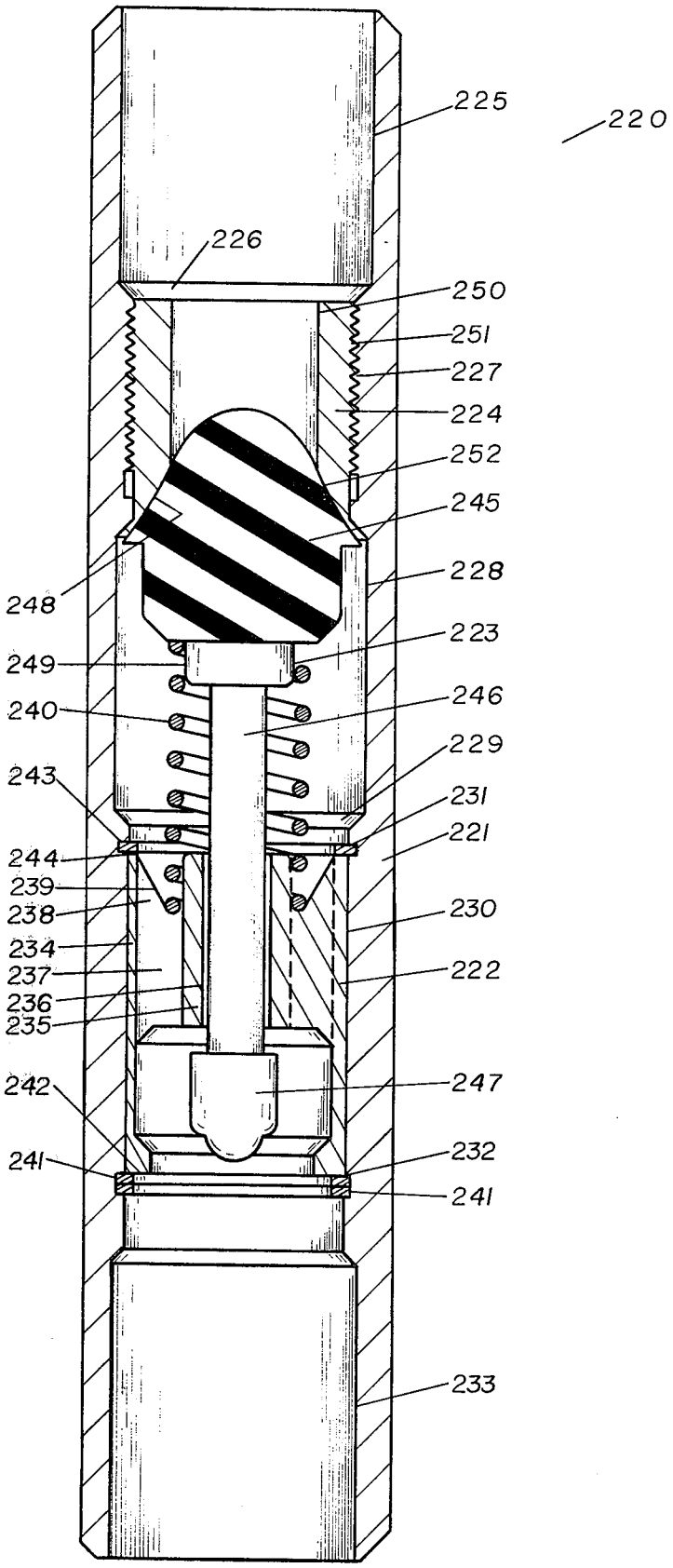
FIG. 8 is a cross-sectional view of a portion of the present invention showing a check valve for use in the grouting system.

Referring now to FIG. 8, the grout check valve 220 is shown. The grout check valve 220 comprises check valve housing 221, valve member guide 222, valve member 223 and valve seat 224.

The check valve housing 221 comprises first bore 225, chamfered surface 226, threaded bore 227, second bore 228, chamfered surface 229, third bore 230 having annular groove 231 and annular groove 232 therein and fourth bore 233.

The valve member guide 222 comprises cyclindrical outer member 234 interconnected to cylindrical inner member 235 having a bore 236 by a plurality of vanes 237. The upper ends 238 of the vanes 237 contain notches 239 therein to receive one end of the valve spring 240.

The valve member guide 222 is retained in the check valve housing 221 by means of resilient snap ring means 241 installed in annular groove 232 abutting lower end surface 242 of the valve member guide 222 while resilient snap ring means 243 installed in annular groove 231 abuts upper end surface 244 of the valve member guide 222. Although the valve member guide 222 has been shown as being retained in position in the check valve housing 221 by means of resilient snap ring means 241 and 243, it may be secured in position by any suitable means such as welding, threaded engagement, etc.

The valve member 223 comprises elastomeric head means 245 secured to stem member 246 which is received in bore 236 of the valve member guide 222 and valve member cap 247 secured to the end thereof. The elastomeric head means 245 is formed having an angular surface 248 to mate with valve seat 224. The valve stem member 246 is formed having a pilot section 249 to receive one end of valve spring 240 thereover. The valve member cap 247 may be secured to the end of the valve member 223 by any suitable means to prevent the withdrawal of the valve stem member 246 from the valve member guide 222.

The valve seat member 224 comprises a cylindrical member having a bore 250 therethrough, threaded exterior surface 251 which engages threaded bore 227 of the valve member housing 221 and angular valve seat surface 252 which receives angular surface 248 of elastomeric valve head 245.

When installed in the valve member housing 221, the elastomeric valve head 245 is urged into engagement with angular annular valve seat surface 252 of valve seat 224 by one end of valve spring 240 abutting the lower surface of elastomeric valve head 245 while the other end of valve spring 240 is received in the notches 239 in the vanes 238 of valve member guide 222.

The grout check valves 220 may be installed in the grout lines 7 by any suitable means, such as welding, to control the flow of grouting material from the pile sleeves being grouted.

Although the grouting check valve means 220 is preferred for installation in the grouting system 20, any suitable commercially available check valve means may be used.

Also, although the grouting check valve means 220 may be installed in any position in the grouting system 20, it is preferred that a grouting check valve means 220 be installed in the grout line 7 leading from sliding sleeve type valve means 150 to the pile sleeve 2.

Figure 9:
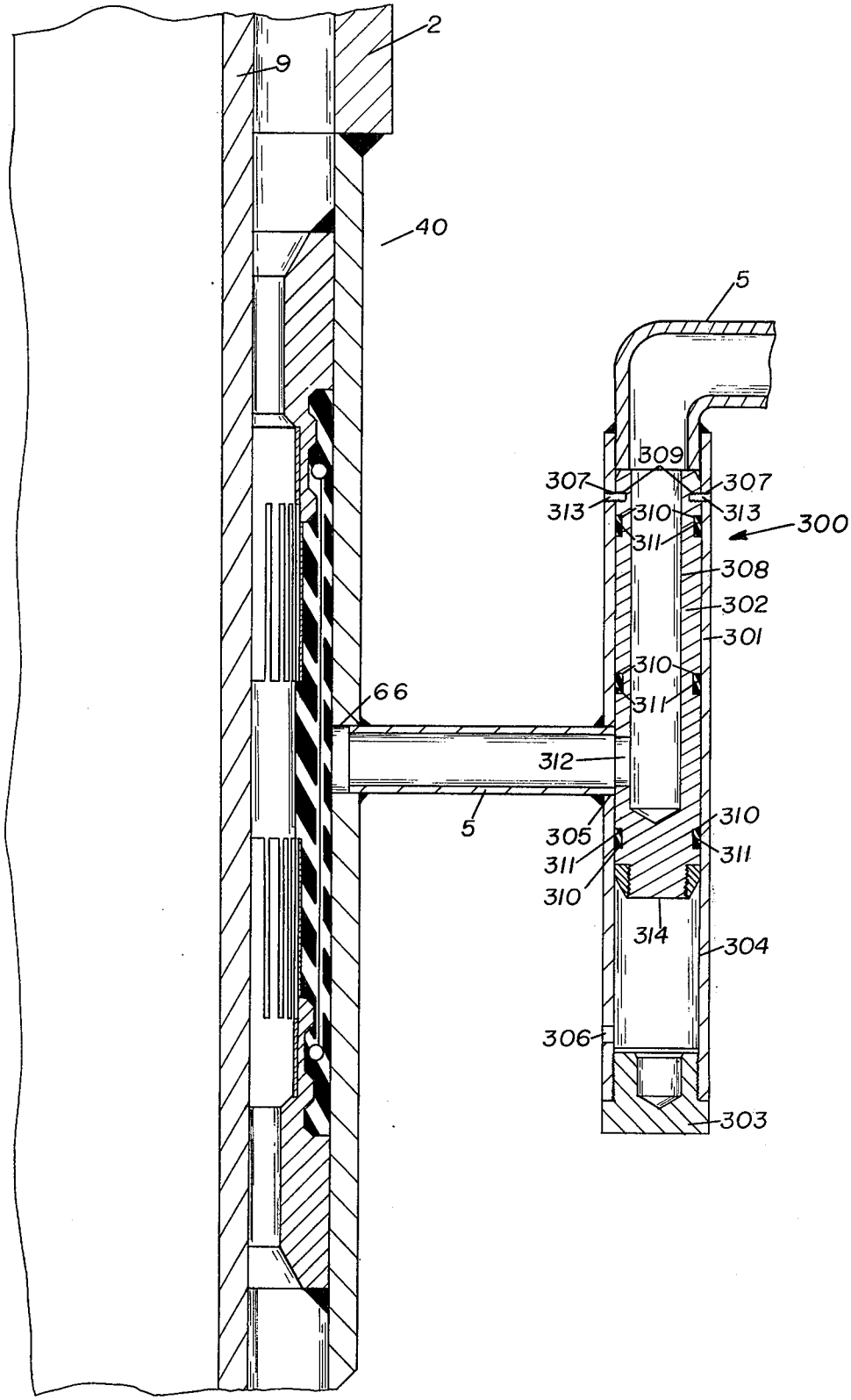
FIG. 9 is a cross-sectional view of the present invention showing a portion of an inflatable packer and a sliding sleeve type check valve assembly therefore which are installed on the lower end of a pile sleeve of an offshore platform.

Referring to FIG. 9, an alternative embodiment of valve means 300 to control the flow of inflation fluid into the lower inflatable packer 40 installed at the bottom of each pile sleeve 2 is shown.

The valve means 300 comprises a sliding sleeve type valve means. The valve means 300 comprises valve housing 301, sliding sleeve 302 and cap means 303.

The valve housing 301 comprises a cylindrical housing having a bore 304 therethrough, port 305 therein connected to inflation line 5 leading to inflation port 66 of the inflatable packer 40, port 306 therein which communicates the bore 304 with the exterior of the valve housing 301, and apertures 307 in the upper end thereof.

The sliding sleeve 302 comprises a cylindrical member having a blind bore 308 therein, blind apertures 309 therein, annular grooves 310 receiving elastomeric seal means 311 therein, and port 312 communicating the blind bore 308 with the inflation line 5 leading to the inflatable packer 40.

To retain the sliding sleeve 302 in the upper position in the valve housing 301 a plurality of shear pins 313 are installed in the apertures 307 of the valve housing 301 and blind apertures 309 of the sliding sleeve 302.

The valve cap 303 comprises a cylindrical plug member inserted into the lower end of valve housing 301. The valve cap 303 may be secured to the valve housing 301 by any suitable means, such as welding, threaded engagement, etc.

The valve housing 301 may be secured to the inflation lines 5 by any suitable means, such as welding, etc.

The elastomeric seal means 311 in the sliding sleeve 302 may be any suitable seal means such as an elastomeric O-ring, an elastomeric seal means having a rectangular cross-sectional shape, etc.

To actuate the sliding sleeve type valve means 300 when the fluid pressure in the inflation line 5 sufficiently exceeds the fluid pressure in bore 304 of the valve housing 301 below the sliding sleeve 302, the shear pins 313 are sheared thereby causing the sliding sleeve 302 to move downwardly in bore 304 until surface 314 of the sliding sleeve 302 abuts valve cap 303. When this occurs, the port 312 is no longer in communication with inflation line 5 and flow from the bore 308 of sleeve 302 is prevented from following into inflation line 5 leading to the inflatable packer 40.

Referring again to FIG. 1, the operation of the inflation system 10 for inflating the inflatable packers 40 installed on the pile sleeves 2 and the operation of the grouting system 20 for grouting the annuli between the piles and the jacket leg 1 and pile sleeves 2 will be set forth.

Regarding the inflation system 10, fluid or gas pressure is supplied from the surface of the offshore platform through inflation line 5 to the sliding sleeve type valve means 190 which selectively controls the flow of inflation fluid to the inflatable packers 40 installed in the pile sleeves 2.

Initially the sliding sleeve type valve means 190 is in the position illustrated in FIG. 4 where the sliding sleeve 193 is blocking the port 201 thereby directing flow through the bore 195 and out the valve means 190 into the inflation line 5 leading to the inflatable packers 40 installed on the pile sleeve 2' which appears on the right hand side of FIG. 1. Since the upper packer inflation control valve 120 installed on the upper inflatable packer 40 on the pile sleeve 2' is in the closed position, as shown in FIG. 3, the fluid or gas flow into the upper packer 40 on the pile sleeve 2' is blocked by the head 131 of the inflation control valve body 123 sealingly engaging bore 124 of the inflation control valve housing 121 thereby directing the flow of fluid or gas through the inflation line 5 leading to the lower packer inflation check valve means 70 and lower inflatable packer 40 connected thereto.

Briefly referring to FIG. 2, when the fluid or gas pressure is sufficient to overcome the valve body spring 89 biasing the valve body into engagement with conical bore 76 of the check valve housing thereby opening lower packer inflation check valve means 70, fluid or gas can flow through lower packer inflation check valve means 70, through inflation line 5 connecting the lower packer inflation check valve means 70 to the inflation port 66 of the lower inflatable packer 40, and through the inflation port 66 thereby causing the packer member 44 to sealingly engage the pile 9 driven through the pile sleeve 2' and lower inflatable packer 40.

Referring again to FIG. 1, at this point, it should be noted that only lower inflatable packer 40 is inflated to sealingly engage the pile 9 (not shown) driven through the pile sleeve 2', that the inflation of the upper inflatable packer 40 installed on the upper end of the pile sleeve 2 has not been inflated by the upper packer inflation control valve 120 preventing the flow of inflation fluid or gas thereinto, and that the flow of inflation fluid or gas to the inflatable packers 40 installed on the other pile sleeve 2 or pile sleeves 2 is blocked or prevented by the sliding sleeve type valve means 190. Since the inflation fluid or gas is only permitted to flow into a single lower inflatable packer 40 installed on the lower end of the pile sleeve 2', the inflation system 10 may be closed in after the lower inflatable packer 40 has been inflated and checked for leaks associated with the single lower inflatable packer 40 that has been inflated by detecting any pressure loss in the inflation system 10 by way of a commerically available pressure gauge installed in the inflation system 10. If the lower inflatable packer 40 is leaking and will not maintain fluid or gas pressure of a sufficient level therein to maintain the packer member 44 in sealing enagement with the pile 9 driven therethrough, a ball of sufficiently small diameter to pass through sliding sleeve type valve means 190 may be pumped or free fall to the lower packer inflation check valve means 70 to block the flow of inflation fluid or gas therethrough.

Still referring to FIG. 1, once the lower inflatable packer 40 on the pile 2' which is shown on the right hand portion of FIG. 1 has been inflated and pressure tested, the pressure of the inflation fluid or gas is increased until the upper packer inflation control valve means 120 is opened allowing fluid or gas to flow through valve means 120, through upper packer check valve means 70, and through inflation port 66 of the upper inflatable packer 40 to cause the packer member 44 to sealingly engage the pile 9 (not shown) driven through the pile sleeve 2' and upper inflatable packer 40 installed thereon.

Referring briefly to FIG. 3, when the inflation fluid or gas pressure reaches a predetermined pressure level, the forces acting on the head 131 of the inflation control valve body 123 are great enough to cause the shear pin 135, which retains the head 131 in sealing engagement with bore 124 of the inflation control valve housing 121, to shear allowing the inflation control valve body 123 to move to the left opening the bore 125 which communicates with inflation line 5 leading to the upper packer check valve means 70 thereby allowing the inflation fluid or gas to flow through the upper packer inflation control valve means 120, through the upper packer check valve means 70 and through inflation port 66 of the upper inflatable packer 40 to inflate the same. When the inflation control valve body 123 moves to the left thereby opening the upper packer inflation control valve means 120 to inflation fluid or gas flow, the stem portion 134 of the valve body 123 is received in blind bore 119 of the valve 122.

Since the operation of the upper packer inflation check valve means 70 is identical to the operation of the lower packer check valve means 70 described hereinbefore, it will not be discussed.

Referring again to FIG. 1, it should be noted that at this point in the packer inflation sequence the flow of inflation fluid or gas is directed solely to the inflatable packers installed on the pile sleeve 2' which appears on the right hand portion of FIG. 1. It should also be noted that since it has been previously determined whether or not the lower inflatable packer 40 installed on the bottom of pile sleeve 2' is leaking and, if so, has been sealed off to prevent the flow of inflation fluid or gas thereto, it is possible to pressure test the upper inflatable packer 40 installed on the upper end of pile sleeve 2'.

To pressure test the upper inflatable packer 40 installed on the upper end of pile sleeve 2', it is only necessary to close in the inflation system 10 after the upper inflatable packer 40 has been inflated and observe any pressure fluctuations on any commercially available gauge installed in the inflation system 10. Since flow is prevented to the inflatable packers 40 installed on the pile sleeve 2 by the sliding sleeve type valve means 190 and since the lower inflatable packer 40 installed on the pile sleeve 2' has been pressure tested and, if leaking, the flow thereto prevented by sealing the lower inflatable packer, any pressure loss in the inflation system will be due to a leak in the upper inflatable packer 40 installed on the upper end of pile sleeve 2'.

Once the upper inflatable packer 40 installed on the upper end of pile sleeve 2' has been inflated and pressure tested, the sliding sleeve type valve means 190 may be actuated to prevent the flow of inflation fluid or gas to the inflatable packers 40 installed on the pile sleeve 2' and to allow the flow of inflation fluid or gas to the inflatable packers 40 installed on the pile sleeve 2 which is shown on the left hand portion of FIG. 1.

Referring to FIG. 5, to actuate sliding sleeve type valve means 190 a ball which is slightly smaller than bore 200 in the first member 191 is inserted in inflation line 5 and pumped or allowed to free fall therethrough until it seats on chamfer 206 of the sleeve 193. When the ball has seated on chamfer 206, the pressure in inflation line 5 is increased until the shear pin 210 is sheared thereby freeing sleeve 193 to move downwardly under the inflation fluid or gas pressure until lower surface 204' abuts shoulder 196 of the second member 192 of the sleeve valve housing. When the sleeve 193 has surface 204' abutting shoulder 196 of the second member 192 of the sleeve valve housing, flow through the sleeve 193 to the inflatable packers 40 installed on the upper and lower ends of pile sleeve 2' is stopped by the ball sealingly engaging chamfer 206. Any subsequent flow is directed through open port 201 and through inflation line 5 leading to the inflatable packers 40 installed on the upper and lower ends of pile sleeve 2.

Referring again to FIG. 1, once the inflation fluid or gas flow is blocked to the inflatable packers 40 installed on the upper and lower ends of pile sleeve 2', the inflatable packers 40 installed on the upper and lower ends of pile sleeve 2 may be inflated and pressure tested in the same manner as that described in connection with the inflatable packers 40 installed on the pile sleeve 2' and, therefore, this procedure will not be discussed regarding pile sleeve 2.

As a back-up safety feature to allow the inflation of the inflatable packers 40 installed on the upper and lower ends of pile sleeve 2 should the sliding sleeve type valve means 190 fail, bypass valve means 30 and pipe tee and plug means 6 are installed in the inflation line 5 to bypass flow around valve means 190. Pipe tee and plug means 6 also allows the bypass valve means 30 to be circumvented should it also fail.

If the sliding sleeve type valve means 190 fails, it can be bypassed to allow inflation fluid or gas flow to the inflatable packers 40 installed on the upper and lower ends of pile sleeve 2 by a diver manually opening the bypass valve means 30 thereby allowing communication from inflation line 5 leading from the surface of the offshore platform to the inflation line 5 leading to the pile sleeve 2. Should the bypass valve means 30 fail a diver may remove the plug from the pipe tee and plug means 6 and connect an auxiliary inflation line 5 leading from the surface of the offshore platform to the pipe tee and plug means 6 to allow the inflation of the inflatable packers 40 installed on the upper and lower ends of pile sleeve 2.

Although the bypass valve means 30 has been described as being, and can be, any manually actuated commercially available valve means, it could also be any type of remotely operated commercially available bypass valve means. The design or type of bypass valve means is not critical but merely a bypass valve means be provided, if desired.

Similarly, any commercially available pipe tee and plug means 6 may be installed in the inflation line 5, if desired.

Once the inflatable packers 40 which are installed on pile sleeves 2 and 2' have been inflated and sealingly engage the piles 9 (not shown) driven through pile sleeves 2 and 2', the annuli between the piles driven through jacket leg 1 and pile sleeves 2 and 2' are ready for grouting through the grouting system 20.

The grouting system 20 controls the flow of fluid grouting materials to the pile sleeve 2 and 2' and the jacket leg 1. When grouting fluid is initially pumped down grout line 7 from the surface of the offshore platform, the grouting fluid flows through the sliding sleeve type valve means 150 and into grout line 8 leading to jacket leg 1.

Briefly referring to FIG. 6, as can be easily seen, any grouting fluid flowing into sliding sleeve type valve means 150 must flow through the valve means 150 since the sleeves 153 and 154 block any flow of grouting fluid through the ports 161 and 162 respectively and the grout lines 7 connected thereto which lead to the pile sleeves 2 and 2'.

Referring to FIG. 7, when the annulus between the pile and jacket leg 1 has been grouted and it is desired to grout the annuli between the pile sleeves 2 and 2' and the piles driven therethrough, the flow of grouting fluid can be directed to the pile sleeve 2 by opening port 161 in the sliding sleeve type valve means 150. To open port 161 to grouting fluid flow a ball, which is slightly smaller in diameter than bore 173 in the second sleeve 154, is inserted in grout line 7 and pumped or allowed to free fall therethrough until it seats on chamfer 166 of the first sleeve 153. When the ball has seated on chamfer 166, the pressure in grout line 7 is increased until the shear pins 170 are sheared thereby freeing the first sleeve 153 to move downwardly in the first member 151 of the sleeve valve housing until lower surface 180 of the first sleeve 153 abuts shoulder 180' of the second member 152 of the sleeve valve housing. When the first sleeve 153 has surface 180 abutting shoulder 180' of the second member 152 of the sleeve valve housing, grouting fluid flow through the first sleeve 153 and grout line 8 is stopped by the ball sealingly engaging chamfer 166. Any subsequent flow is directed through open port 161 and through grout line 7 connected thereto leading to pile sleeve 2.

Referring to FIG. 1 again, once port 161 is open in sliding sleeve type valve means 150 allowing grouting fluid to flow therethrough into grout line 7 connected thereto, the grouting fluid flows through grout line 7, through pipe tee and plug means 6, through grout control check valve means 220 and through grout line 7 into the annulus formed between the pile sleeve 2 and the pile 9, not shown, driven therethrough.

When the annulus between the pile sleeve 2 and pile driven therethrough is full of grouting fluid, continued flow of the grouting fluid into the pile sleeve 2 will cause the grouting fluid to flow from the annulus between the pile sleeve 2 and pile 9, not shown, driven therethrough into the grout line 7 which is connected to the upper end of the pile sleeve 2 and runs to the surface of the offshore platform. In this manner, by continuing the flow of grouting fluid into the pile sleeve 2 the quality of the grouting fluid in the pile sleeve 2 may be checked at the surface of the offshore platform.

When the desired quality of the grouting fluid being returned to the surface of the offshore platform is reached, the flow of grouting fluid to the pile sleeve 2 may be discontinued. It should be noted that any cessation of grouting fluid flow to pile sleeve 2 will not cause the grouting fluid contained within the annulus formed between the pile sleeve 2 and pile driven therethrough to flow backwardly through the grouting system 20 due to the grout control check valve means 220 installed in the grouting system 20.

Referring briefly to FIG. 8, if grouting flow into the pile sleeve 2 ceases for any reason, the elastomeric valve head 245 is urged into engagement with angular annular valve seat surface 252 of the valve seat 224 by the valve spring 240 thereby preventing grouting fluid flow backwardly through the grouting system 20.

As a back-up safety feature to allow the grouting of the annulus between pile sleeve 2 and the pile 9, not shown, driven therethrough should the sliding sleeve type valve means 150 fail, bypass valve means 30 and pipe tee and plug means 6 are installed in the grout line 7 to bypass flow around valve means 150. Pipe tee and plug means 6 also allows the bypass valve means 30 to be circumvented should it also fail.

If the sliding sleeve type valve means 150 fails, it can be bypassed to allow grouting fluid to flow to the pile sleeve 2 by a diver manually opening the bypass valve means 30 thereby allowing communication from grout line 7 leading from the surface of the offshore platform to the inflation line 5 leading to the pile sleeve 2. Should the bypass valve means 30 fail, a diver may remove the plug from the pipe tee and plug means 6 and connect an auxiliary grout line 7 leading from the surface of the offshore platform to the pipe tee and plug means 6 to allow the grouting fluid to flow to the pile sleeve 2.

Although the bypass valve means 30 has been described as being and can be any manually actuated commercially available valve means, it could also be any type of remotely operated commercially available bypass valve means. The design or type of bypass valve means is not critical but merely a bypass valve means to be provided, if desired.

Similarly, any commercially available pipe tee and plug means 6 may be installed in the grout line 7, if desired.

Referring briefly to FIG. 7, when the annulus formed between the pile sleeve 2 and pile 9 driven therethrough is filled with satisfactory quality of grouting fluid and it is desired to fill the annulus formed between the pile sleeve 2' and the pile 9 driven therethrough, the flow of grouting fluid can be directed to the pile sleeve 2' by opening port 162 in the sliding sleeve type valve means 150. To open port 162 to grouting fluid flow a ball (not shown), which is slightly smaller in diameter than the internal diameter of the grout line 7 leading to the sliding sleeve type valve means 150 and the bore of first member 151 thereof is inserted in grout line 7 and pumped or allowed to free fall therethrough until it seats on chamfer 174. When the ball has seated on chamfer 174, the pressure in grout line 7 is increased until the shear pins 170 are sheared thereby freeing the second sleeve 154 to move downwardly in the first member 151 of the sleeve valve housing until the lower surface 178 abuts the upper surface 179 of the first sleeve 153, at which time the port 162 in the first member 151 of the sleeve valve housing is uncovered and port 161 is sealed by the second sleeve 154.

When the second sleeve 154 has surface 178 abutting upper surface 179 of the first sleeve 153, flow through the second sleeve 154 is stopped by the ball sealingly engaging chamfer 174. Any subsequent flow is directed through open port 162 and through grout line 7 connected thereto which, in turn, is connected to pile sleeve 2'.

Referring to FIG. 1 again, once port 162 is open in sliding sleeve type valve means 150 allowing grouting fluid to flow therethrough into grout line 7 connected thereto, the grouting fluid flows through grout line 7, through pipe tee and plug means 6, through grout control check valve means 220 and through grout line 7 into the annulus formed between the pile sleeve 2' and the pile 9, not shown, driven therethrough.

As with the grouting procedure described with respect to pile sleeve 2, when the annulus between the pile sleeve 2 and pile driven therethrough is full of grouting fluid, continued flow of the grouting fluid into the pile sleeve 2' will cause the grouting fluid to flow from the annulus between the pile sleeve 2' and pile driven therethrough into the grout line 7 connected to the upper end of the pile sleeve 2' and running to the surface of the offshore platform. In this manner, by continuing the flow of grouting fluid into the pile sleeve 2' the quality of the grouting fluid in the pile sleeve 2' may be checked at the surface of the offshore platform.

As discussed before, when the desired quality of the grouting fluid being returned to the surface of the offshore platform is reached, the flow of grouting fluid to the pile sleeve 2' may be discontinued. It should be noted that any cessation of grouting fluid flow to pile sleeve 2' will not cause the grouting fluid contained within the annulus formed between the pile sleeve 2' and pile driven therethrough to flow backwardly through the grouting system 20 due to the grout control check valve means 220 installed in the grouting system 20.

Since the grout control check valve means 220 has been described hereinbefore and its role in the grouting of the pile sleeve 2 has been described hereinbefore and since the grout control check valve means 220 is identical to the earlier discussed grout control check valve means 220 in structure and function, it will not be discussed further.

As a backup safety feature to allow the grouting of the annulus between pile sleeve 2' and the pile 9 (not shown) driven therethrough should the sliding sleeve type valve means 150 fail, bypass valve means and pipe tee and plug means 6 are installed in the grout line 7 to bypass flow around valve means 150. Pipe tee and plug means 6 also allows the bypass valve means 30 to be circumvented should it also fail.

Since the bypass valve means 30 and pipe tee and plug means 6 have been discussed hereinbefore with respect to the grouting of pile sleeve 2 and since they are of identical structure and function, bypass valve means 30 and pipe tee and plug means 6 will not be discussed with respect to the grouting of pile sleeve 2'.

Although the present invention has been described with respect to an inflation system and grouting system for a jacket leg and two pile sleeves connected thereto, various modifications are within the scope of the present invention.

For instance, where it is desired to inflate more than one inflatable packer installed on the lower end of a pile sleeve on a plurality of pile sleeves, a lower packer inflation control valve means 120 may be installed on each lower inflatable packer with each lower packer inflation control valve means 120 having a different actuating pressure thereby allowing the sequential inflation of the multiple inflatable packers from a single inflation line leading from the sliding sleeve valve means installed in the inflation system.

Similarly, if so desired, the sliding sleeve valve means may be eliminated from the inflation system and packer inflation control valve means 120 installed on each packer to be inflated with each packer inflation control valve means 120 having a different actuating pressure thereby allowing the sequential inflation of the multiple inflatable packers from a single inflation line leading to the surface of the offshore platform.

Similarly, the grouting system may include grout system control valves 120, which are identical in construction to the packer inflation control valves 120, installed on the grout inlet of each pile sleeve or jacket leg with each control valve 120 having a different actuating pressure thereby allowing the sequential grouting of the jacket legs and pile sleeves connected to the grouting line leading from the outlet port of the sliding sleeve type valve means installed in the grouting system. In order to sequentially actuate the grout system control valves 120 which are installed on the grout inlet of each pile sleeve or jacket leg, after the annulus formed between the pile and pile sleeve or jacket leg has been filled with a quantity of grouting fluid having satisfactory quality, the grout return line leading from the jacket leg or pile sleeve to the surface of the offshore platform is closed and the pressure in the grout line 7 raised to a sufficient level to actuate the next grout control valve 120 installed on the grout inlet of the next pile sleeve or jacket leg to be grouted.

In this connection, if it is desirable to delete the sliding sleeve type valve means 150 in the grouting system 20, the various pile sleeves and jacket legs may be grouted sequentially by installing grout system control valves 120, which are identical in construction to the packer inflation control valve means 120, on the grout inlet of each pile sleeve or jacket leg with each control valve 120 having a different actuating pressure thereby allowing the sequential grouting the jacket legs and pile sleeves. In order to sequentially actuate the grout system control valves 120 which are installed on the grout inlet of each pile sleeve or jacket leg, after the annulus between the pile and pile sleeve or jacket leg has been filled with a quantity of grouting fluid having satisfactory quality, the grout return line leading from the pile sleeve or jacket leg to the surface of the offshore platform is closed and the pressure in the grout line 7 raised to a sufficient level to actuate the next grout control valve 120 installed on the grout inlet of the next pile sleeve or jacket leg to be grouted.

Where it is desired to have a complete back-up system for the inflation of the inflatable packers and the grouting of the pile sleeves or jacket legs, another complete inflation system 10 and grout system 20 may be installed on the pile sleeves and jacket legs at a position opposite to the first inflation system 10 and grout system 20 on the pile sleeves and jacket legs. If this is done, a completely redundant inflation system 10 and grouting system 20 can be added to the pile sleeves and jacket legs merely by running one extra inflation line 5 and grout line 7 to the surface of the offshore platform.

It may also be desirable in certain instances to install control valves on each inflatable packer which is connected to a first inflation system 10 and at another position on the inflatable packers install a second control valve thereon which is connected to a second inflation system 10. If two control valves which are interconnected to two separate inflation systems 10 are installed on each inflatable packer, a complete back-up inflation system 10 is provided in case one of the inflation systems 10 is damaged and not functioning. Also, by utilizing control valves on each inflatable packer, the inflation lines 5 leading to the inflatable packers 40 can be filled with liquid prior to the setting or installation of the offshore platform without causing the inflatable packers to inflate due to the hydrostatic fluid pressure in the inflation lines 5 filled with liquid when the offshore platform is removed from the barges transporting it to the desired location and placed in a vertical position during the installation of the offshore platform. By filling the inflation lines before the installation of the offshore platform valuable time can be saved during the installation of the offshore platform because it is unnecessary to fill hundreds of feet of inflation line with liquid.

As can be readily seen from the foregoing discussion, the present invention offers significant advantages over the prior art grouting systems.

One advantage of the present invention over the prior art grouting systems is that in comparison to a conventional grouting system with an inflation running to each inflatable packer and a separate grouting support line running to each jacket leg and pile sleeve from the surface of the offshore platform, the present invention greatly reduces the number of inflation and grouting lines running from the surface to the offshore platform to the jacket legs and pile sleeves thereof.

Another advantage over prior art inflation and grouting systems which supply the inflation fluid and grouting fluid to the pile sleeves of an offshore platform through a single line running to the surface of the offshore platform from the pile sleeves is that in the present invention the inflation system for inflating the packers and the grouting system for supplying grouting fluid to the pile sleeves and jacket legs are totally separate from each other thereby avoiding the contamination of the inflatable packers with grouting fluid and allowing the independent pressure testing of the inflatable packers to discover if any of the packers have failed or are inoperable thereby allowing the grouting procedure to be altered, if so desired.

Another advantage of the present invention is the inclusion in the inflation system and the grouting system of a series of bypass valves and plugs that can be operated to control the flow of the inflation fluid or gas and the grouting fluid if portions of either the inflation system or grouting system fail to operate.

Another advantage of the present invention is that by running one extra inflation line and grout line to the surface of the offshore platform a completely redundant inflation system and grouting system may be installed on the pile sleeves and jacket leg.

Another advantage of the present invention is that by using inflation control valves on each inflatable packer the inflation lines may be filled with liquid before the offshore platform is installed.

While the invention herein regarding the inflatable packers, inflation system and grouting system for the grouting of the pile sleeves and jacket legs of offshore platforms have been described with reference to various embodiments, it will be appreciated by those skilled in the art that additions, deletions, modifications and substitutions, or other changes not specifically described may be made which fall within the purview of the appended claims.

What is claimed as new and desired to be secured by Letters Patent is:

1. An inflation control valve system and a grouting control valve system for controlling the pressure and flow of inflation fluid during the inflation of upper inflatable packers and lower inflatable packers installed on a plurality of pile sleeves of an offshore platform and for controlling the pressure and flow of grouting material during the grouting of the annuli formed between a jacket leg and a pile driven therethrough and said plurality of pile sleeves and piles driven therethrough of said offshore platform, said inflation control valve system utilizing a single inflation line from the surface of said offshore platform to supply said inflation fluid to said upper inflatable packers and said lower inflatable packers installed on said plurality of pile sleeves and said grouting control valve system utilizing a single line from the surface of said offshore platform to supply said grouting material to said annuli, wherein said inflation control valve system comprises:

upper packer inflation control valve means controlling the pressure at which said inflation fluid initially flows into said upper inflatable packers;

upper packer inflation check valve means connected to said upper packer inflation control valve means preventing said flow of inflation fluid from said upper inflatable packers after the inflation thereof;

lower packer inflation check valve means preventing said flow of inflation fluid from said lower inflatable packers after the inflation thereof; and inflation valve means connected to said single inflation line to selectively control said flow of inflation fluid to said upper inflatable packer and said lower inflatable packer installed on a first pile sleeve of said plurality of pile sleeves and another upper inflatable packer and lower inflatable packer installed on a second pile sleeve of said plurality of pile sleeves; and wherein said grouting control valve system comprises:

grouting valve means connected to said single grouting line to selectively control said flow of grouting material to said annuli.

2. The apparatus of claim 1 wherein said inflation control valve system further comprises:

bypass valve means to bypass said flow of inflation fluid around said inflation valve means to said upper inflatable packer and said lower inflatable packer installed on a pile sleeve of said plurality of pile sleeves.

3. The apparatus of claim 1 wherein said inflation control valve system further comprises:

pipe tee and plug means to allow inflation fluid to be supplied to the upper inflatable packer and the lower inflatable packer installed on a pile sleeve of said plurality of pile sleeves.

4. The apparatus of claim 1 wherein said inflation valve means connected to said single inflation line comprises a sleeve valve.

5. The apparatus of claim 1 wherein said inflation fluid comprises a liquid.

6. The apparatus of claim 1 wherein said inflation fluid comprises a gas.

7. The apparatus of claim 1 wherein said grouting control valve system further comprises:

first bypass valve means to bypass said flow of grouting material around said grouting valve means to an annulus formed between a first pile sleeve and pile driven therethrough of said plurality of pile sleeves.

8. The apparatus of claim 7 wherein said grouting control valve system further comprises:

second bypass valve means to bypass said flow of grouting material around said grouting valve means to a second annulus formed between a second pile sleeve and pile driven therethrough of said plurality of pile sleeves.

9. The apparatus of claim 1 wherein said grouting control valve system further comprises:

grout control check valve means to control said flow of grouting material from said annuli.

10. The apparatus of claim 1 wherein said grouting control valve system further comprises:

pipe tee and plug means to allow grouting material to be supplied to said annuli.

11. An inflation control valve system and a grouting control valve system for controlling the pressure and flow of inflation fluid during the inflation of upper inflatable packers and lower inflatable packers installed on a plurality of pile sleeves of an offshore platform and for controlling the pressure and flow of grouting material during the grouting of the annuli formed between a jacket leg and a pile driven therethrough and said plurality of pile sleeves and piles driven therethrough of said offshore platform, said inflation control valve system utilizing a single inflation line from the surface of said offshore platform to supply said inflation fluid to said upper inflatable packers and said lower inflatable packers installed on said plurality of pile sleeves and said grouting control valve system utilizing a single line from the surface of said offshore platform to supply said grouting material to said annuli, wherein said inflation control valve system comprises:

upper packer inflation control valve means controlling the pressure at which said inflation fluid initially flows into said upper inflatable packer;

upper packer inflation check valve means connected to said upper packer inflation control valve means preventing said flow of inflation fluid from said upper inflatable packer after the inflation thereof;

lower packer inflation check valve means preventing said flow of inflation fluid from said lower inflatable packer after the inflation thereof;

inflation valve means connected to said single inflation line to selectively control said flow of inflation fluid to said upper inflatable packer and said lower inflatable packer installed on a first pile sleeve of said plurality of pile sleeves and another upper inflatable packer and lower inflatable packer installed on a second pile sleeve of said plurality of pile sleeves;

bypass valve means to bypass said flow of inflation fluid around said inflation valve means to said upper inflatable packer and said lower inflatable packer installed on a pile sleeve of said plurality of pile sleeves; and pipe tee and plug means to allow inflation fluid to be supplied to the upper inflatable packer and the lower inflatable packer installed on a pile sleeve of said plurality of pile sleeves; and wherein said grouting control valve system comprises:

grouting valve means connected to said single grouting line to selectively control said flow of grouting material to said annuli;

first bypass valve means to bypass said flow of grouting material around said grouting valve means to an annulus formed between a first pile sleeve and pile driven therethrough of said plurality of pile sleeves;

second bypass valve means to bypass said flow of grouting material around said grouting valve means to a second annulus formed between a second pile sleeve and pile driven therethrough of said plurality of pile sleeves;

grout control check valve means to control said flow of grouting material from said annuli; and pipe tee and plug means to allow grouting material to be supplied to said annuli.

12. An inflation control valve system and grouting control valve system for controlling the pressure and flow of inflation fluid during the inflation of upper inflatable packers and lower inflatable packers installed on a plurality of pile sleeves of an offshore platform and for controlling the pressure and flow of grouting material during the grouting of the annuli formed between said plurality of pile sleeves and piles driven therethrough of said offshore platform, said inflation control valve system utilizing a single inflation line from the surface of said offshore platform to supply said inflation fluid to said upper inflatable packers and said lower inflatable packers installed on said plurality of pile sleeves and said grouting control valve system utilizing a single line from the surface of said offshore platform to supply said grouting material to said annuli;

wherein said inflation control valve system comprises:

upper packer inflation control valve means controlling the pressure at which said inflation fluid initially flows into said upper inflatable packers;

upper packer inflation check valve means connected to said upper packer inflation control valve means preventing said flow of inflation fluid from said upper inflatable packers after the inflation thereof;

lower packer inflation check valve means preventing said flow of inflation fluid from said lower inflatable packers after the inflation thereof; and inflation valve means connected to said single inflation line to selectively control said flow of inflation fluid to said upper inflatable packer and said lower inflatable packer installed on a first pile sleeve of said plurality of pile sleeves and another upper inflatable packer and lower inflatable packer installed on a second pile sleeve of said plurality of pile sleeves; and wherein said grouting control valve system comprises:

grouting valve means connected to said single grouting line to selectively control said flow of grouting material to said annuli.

13. The apparatus of claim 12 wherein said inflation fluid is a liquid.

14. The apparatus of claim 12 wherein said inflation fluid is a gas.

15. An inflation control valve system and a grouting control valve system for controlling the pressure and flow of inflation fluid during the inflation of upper inflatable packers and lower inflatable packers installed on a plurality of pile sleeves of an offshore platform and an inflatable packer installed on the bottom of a jacket leg of an offshore platform and for controlling the pressure and flow of grouting material during the grouting of the annuli formed between said jacket leg and a pile driven therethrough and said plurality of pile sleeves and piles driven therethrough of said offshore platform, said inflation control valve system utilizing a single inflation line from the surface of said offshore platform to supply said inflation fluid to said upper inflatable packers and said lower inflatable packers installed on said plurality of pile sleeves and said inflatable packer installed on the bottom of said jacket leg and said grouting control valve system utilizing a single line from the surface of said offshore platform to supply said grouting material to said annuli, wherein said inflation control valve system comprises:

upper packer inflation control valve means controlling the pressure at which said inflation fluid initially flows into said upper inflatable packers;

upper packer inflation check valve means connected to said upper packer inflation control valve means preventing said flow of inflation fluid from said upper inflatable packers after the inflation thereof;

lower packer inflation check valve means preventing said flow of inflation fluid from said lower inflatable packers after the inflation thereof; and inflation valve means connected to said single inflation line to selectively control said flow of inflation fluid to said lower inflatable packer installed on said jacket leg, to said upper inflatable packer and said lower inflatable packer installed on a first pile sleeve of said plurality of pile sleeves and to another said upper inflatable packer and said lower inflatable packer installed on a second pile sleeve of said plurality of pile sleeves; and wherein said grouting control valve system comprises:

grouting valve means connected to said single grouting line to selectively control said flow of grouting material to said annuli.

16. The apparatus of claim 15 wherein said inflation control valve system further comprises:

bypass valve means to bypass said flow of inflation fluid around said inflation valve means to said upper inflatable packer and said lower inflatable packer installed on a pile sleeve of said plurality of pile sleeves.

17. The apparatus of claim 15 wherein said inflation control valve system further comprises:

pipe tee and plug means to allow inflation fluid to be supplied to the upper inflatable packer and the lower inflatable packer installed on a pile sleeve of said plurality of pile sleeves.

18. The apparatus of claim 15 wherein said inflation valve means connected to said single inflation line comprises a sleeve valve.

19. The apparatus of claim 15 wherein said inflation fluid comprises a liquid.

20. The apparatus of claim 15 wherein said inflation fluid comprises a gas.

21. The apparatus of claim 15 wherein said grouting control valve system further comprises:

first bypass valve means to bypass said flow of grouting material around said grouting valve means to an annulus formed between a first pile sleeve and pile driven therethrough of said plurality of pile sleeves.

22. The apparatus of claim 15 wherein said grouting control valve system further comprises:

second bypass valve means to bypass said flow of grouting material around said grouting valve means to a second annulus formed between a second pile sleeve and pile driven therethrough of said plurality of pile sleeves.

23. The apparatus of claim 15 wherein said grouting control valve system further comprises:

grout control check valve means to control said flow of grouting material from said annuli.

24. The apparatus of claim 15 wherein said grouting control valve system further comprises:

pipe tee and plug means to allow grouting material to be supplied to said annuli.

25. An inflation control valve system and a grouting control valve system for controlling the pressure and flow of inflation fluid during the inflation of upper inflatable packers and lower inflatable packers installed on a plurality of pile sleeves of an offshore platform and for controlling the pressure and flow of grouting material during the grouting of the annuli formed between a jacket leg and a pile driven therethrough and said plurality of pile sleeves and piles driven therethrough of said offshore platform, said inflation control valve system utilizing a single line from the surface of said offshore platform to supply said inflation fluid to said upper inflatable packers and said lower inflatable packers installed on said plurality of pile sleeves and said grouting control valve system utilizing a single line from the surface of said offshore platform to supply said grouting material to said annuli, wherein said inflation control valve system comprises:

upper packer inflation control valve means controlling the pressure at which said inflation fluid initially flows into said upper inflatable packers;

upper packer inflation check valve means connected to said upper packer inflation control valve means preventing said flow of inflation fluid from said upper inflatable packers after the inflation thereof;

lower packer inflation control valve means controlling the pressure at which said inflation fluid initially flows into said lower inflatable packers; and lower packer check valve means connected to said lower packer inflation control valve means preventing said flow of inflation fluid from said lower inflatable packers after the inflation thereof; and wherein said grouting control valve system comprises:

grouting valve means connected to said single grouting line to selectively control said flow of grouting material to said annuli.

26. The apparatus of claim 25 wherein said inflation control valve system further comprises:

inflation valve means connected to said single inflation line to selectively control said flow of inflation fluid to said upper inflatable packer and said lower inflatable packer installed on a first pile sleeve of said plurality of pile sleeves and to another said upper inflatable packer and said lower inflatable packer installed on a second pile sleeve of said plurality of pile sleeves.

27. The apparatus of claim 26 wherein said inflation control valve system further comprises:

bypass valve means to bypass said flow of inflation fluid around said inflation valve means to said upper inflatable packer and said lower inflatable packer installed on a pile sleeve of said plurality of pile sleeves.

28. The apparatus of claim 26 wherein said inflation control valve system further comprises:

pipe tee and plug means to allow inflation fluid to be supplied to the upper inflatable packer and the lower inflatable packer installed on a pile sleeve of said plurality of pile sleeves.

29. The apparatus of claim 25 wherein said inflation fluid comprises a liquid.

30. The apparatus of claim 25 wherein said inflation fluid comprises a gas.

31. The apparatus of claim 25 wherein said grouting valve means comprises a sliding sleeve type valve means to selectively control said flow of grouting material to said annuli.

32. The apparatus of claim 31 wherein said grouting control valve system further comprises:

first bypass valve means to bypass said flow of grouting material around said grouting valve means to an annulus formed between a first pile sleeve and pile driven therethrough of said plurality of pile sleeves.

33. The apparatus of claim 31 wherein said grouting control valve system further comprises:

second bypass valve means to bypass said flow of grouting material around said grouting valve means to a second annulus formed between a second pile sleeve and pile driven therethrough of said plurality of pile sleeves.

34. The apparatus of claim 31 wherein said grouting control valve system further comprises:

grout control check valve means to control said flow of grouting material from said annuli.

35. The apparatus of claim 31 wherein said grouting control valve system further comprises:

pipe tee and plug means to allow grouting material to be supplied to said annuli.

36. The apparatus of claim 25 wherein said grouting valve means comprises a pressure actuated grouting valve means to selectively control said flow of grouting material to said annuli by selectively controlling the initial pressure of said flow of grouting material to said annuli.

37. An inflation control valve system and a grouting control valve system for controlling the pressure and flow of inflation fluid during the inflation of upper inflatable packers and lower inflatable packers intalled on a plurality of pile sleeves of an offshore platform and for controlling the pressure and flow of grouting material during the grouting of the annuli formed between a jacket leg and a pile driven therethrough and said plurality of pile sleeves and piles driven therethrough of said offshore platform, wherein said inflation control valve system comprises:

upper packer inflation control valve means controlling the pressure at which said inflation fluid initially flows into said upper inflatable packers;

upper packer inflation check valve means connected to said upper packer inflation control valve means preventing said flow of inflation fluid from said upper inflatable packers after the inflation thereof;

lower packer inflation check valve means preventing said flow of inflation fluid from said lower inflatable packers after the inflation thereof; and inflation valve means to selectively control said flow of inflation fluid to said upper inflatable packers and said lower inflatable packers installed on a first array of pile sleeves of said plurality of pile sleeves and to other said upper inflatable packers and said lower inflatable packers install on a second array of pile sleeves of said plurality of pile sleeves wherein an array of pile sleeves contain at least one pile sleeve of said plurality of pile sleeves; and wherein said grouting control valve system comprises:

grouting valve means to selectively control said flow of grouting material to said annuli.

38. The apparatus of claim 37 wherein said inflation control valve system further comprises:

lower packer inflation control valve means connected to said lower packer inflation check valve means controlling the pressure at which said inflation fluid initially flows into said lower inflatable packers.

39. The apparatus of claim 37 wherein said grouting valve means comprises a sliding sleeve type valve means to selectively control said flow of grouting material to said annuli.

40. The apparatus of claim 37 wherein said grouting valve means comprises a pressure actuated grouting valve means to selectively control said flow of grouting material to said annuli by selectively controlling the initial pressure of said flow of grouting material to said annuli.

41. The apparatus of claim 37 wherein the grouting valve means selectively controls said flow of grouting material to said annulus of said jacket leg, to said annuli of the first array of pile sleeves and to said annuli of the second array of pile sleeves and wherein said grouting control valve system further comprises:

first pressure actuated grouting valve means to selectively control said flow of grouting material to said annuli of the first array of pile sleeves; and second pressure actuated grouting valve means to selectively control said flow of grouting material to said annuli of the second array of pile sleeves.

42. An inflation control valve system and a grouting control valve system for controlling the pressure and flow of inflation fluid during the inflation of upper inflatable packers and lower inflatable packers installed on a plurality of pile sleeves of an offshore platform and for controlling the pressure and flow of grouting material during the grouting of the annuli formed between said plurality of pile sleeves and piles driven therethrough of said offshore platform, wherein said inflation control valve system comprises:

upper packer inflation control valve means controlling the pressure at which said inflation fluid initially flows into said upper inflatable packers;

upper packer inflation check valve means connected to said upper packer inflation control valve means preventing said flow of inflation fluid from said upper inflatable packers after the inflation thereof;

lower packer inflation check valve means preventing said flow of inflation fluid from said lower inflatable packers after the inflation thereof; and inflation valve means to selectively control said flow of inflation fluid to said upper inflatable packers and said lower inflatable packers installed on a first array of pile sleeves of said plurality of pile sleeves and to other said upper inflatable packers and said lower inflatable packers installed on a second array of pile sleeves of said plurality of pile sleeves wherein an array of pile sleeves contain at least one pile sleeve of said plurality of pile sleeves; and wherein said grouting control valve system comprises:

grouting valve means to selectively control said flow of grouting material to said annuli.

43. The apparatus of claim 42 wherein said inflation control valve system further comprises:

lower packer inflation control valve means connected to said lower packer inflation check valve means controlling the pressure at which said inflation fluid initially flows into said lower inflatable packers.

44. The apparatus of claim 42 wherein said grouting valve means comprises a sliding sleeve type valve means to selectively control said flow of grouting material to said annuli.

45. The apparatus of claim 42 wherein said grouting valve means comprises a pressure actuated grouting valve means to selectively control said flow of grouting material to said annuli by selectively controlling the initial pressure of said flow of grouting material to said annuli.

46. The apparatus of claim 42 wherein the grouting valve means selectively controls said flow of grouting material to said annuli of the first array of pile sleeves and to said annuli of the second array of pile sleeves and wherein said grouting control valve system further comprises:

first pressure actuated grouting valve means to selectively control said flow of grouting material to said annuli of the first array of pile sleeves; and second pressure actuated grouting valve means to selectively control said flow of grouting material to said annuli of the second array of pile sleeves.

47. An inflation control valve system and a grouting control valve system for controlling the pressure and flow of inflation fluid during the inflation of upper inflatable packers and lower inflatable packers installed on a plurality of pile sleeves and a lower inflatable packer installed on a jacket let of an offshore platform and for controlling the pressure and flow of grouting material during the grouting of the annuli formed between said plurality of pile sleeves and piles driven therethrough and said jacket leg and pile driven therethrough of said offshore platform, wherein said inflation control valve system comprises:

upper packer inflation control valve means controlling the pressure at which said inflation fluid initially flows into said upper inflatable packers;

upper packer inflation check valve means connected to said upper packer inflation control valve means preventing said flow of inflation fluid from said upper inflatable packers after the inflation thereof;

lower packer inflation check valve means preventing said flow of inflation fluid from said lower inflatable packers after the inflation thereof; and inflation valve means to selectively control said flow of inflation fluid to said upper inflatable packers and said lower inflatable packers installed on a first array of pile sleeves of said plurality of pile sleeves, to other said upper inflatable packers and said lower inflatable packers installed on a second array of pile sleeves of said plurality of pile sleeves wherein an array of pile sleeves contain at least one pile sleeve of said plurality of pile sleeves, and to said lower inflatable packer installed on said jacket leg; and wherein said grouting control valve system comprises:

grouting valve means to selectively control said flow of grouting material to said annuli.

48. The apparatus of claim 47 wherein said inflation control valve system further comprises:

lower packer inflation control valve means connected to said lower packer inflation check valve means controlling the pressure at which said inflation fluid initially flows into said lower inflatable packers.

49. The apparatus of claim 47 wherein said grouting valve means comprises a sliding sleeve type valve means to selectively control said flow of grouting material to said annuli.

50. The apparatus of claim 47 wherein said grouting valve means comprises a pressure actuated grouting valve means to selectively control said flow of grouting material to said annuli by selectively controlling the initial pressure of said flow of grouting material to said annuli.

51. The apparatus of claim 47 wherein the grouting valve means selectively controls said flow of grouting material to said annulus of said jacket leg, to said annuli of the first array of pile sleeves and to said annuli of the second array of pile sleeves and wherein said grouting control valve system further comprises:

first pressure actuated grouting valve means to selectively control said flow of grouting material to said annuli of the first array of pile sleeves; and second pressure actuated grouting valve means to selectively control said flow of grouting material to said annuli of the second array of pile sleeves.

52. An inflation control valve system and a grouting control valve system for controlling the pressure and flow of inflation fluid during the inflation of upper inflatable packers and lower inflatable packers installed on a plurality of pile sleeves of an offshore platform and for controlling the pressure and flow of grouting material during the grouting of the annuli formed between said plurality of pile sleeves and piles driven therethrough of said offshore platform, wherein said inflation control valve system comprises:

upper packer inflation control valve means controlling the pressure at which said inflation fluid initially flows into said upper inflatable packers;

upper packer inflation check valve means connected to said upper packer inflation control valve means preventing said flow of inflation fluid from said upper inflatable packers after the inflation thereof;

lower packer inflation control valve means controlling the pressure at which said inflation fluid initially flows into said lower inflatable packers; and wherein said grouting control valve system comprises:

grouting valve means to selectively control said flow of grouting material to said annuli.

53. The apparatus of claim 52 wherein said inflation control valve system further comprises:

inflation valve means to selectively control said flow of inflation fluid to said upper inflatable packer and said lower inflatable packer installed on a first pile sleeve of said plurality of pile sleeves and to another said upper inflatable packer and said lower inflatable packer installed on a second pile sleeve of said plurality of pile sleeves.

54. The apparatus of claim 53 wherein said inflation control valve system further comprises:

bypass valve means to bypass said flow of inflation fluid around said inflation valve means to said upper inflatable packer and said lower inflatable packer installed on a pile sleeve of said plurality of pile sleeves.

55. The apparatus of claim 53 wherein said inflation control valve system further comprises:

pipe tee and plug means to allow inflation fluid to be supplied to the upper inflatable packer and the lower inflatable packer installed on a pile sleeve of said plurality of pile sleeves.

56. The apparatus of claim 52 wherein said inflation fluid comprises a liquid.

57. The apparatus of claim 52 wherein said inflation fluid comprises a gas.

58. The apparatus of claim 52 wherein said grouting valve means comprises a sliding sleeve type valve means to selectively control said flow of grouting material to said annuli.

59. The apparatus of claim 58 wherein said grouting control valve system further comprises:

first bypass valve means to bypass said flow of grouting material around said grouting valve means to an annulus formed between a first pile sleeve and pile driven therethrough of said plurality of pile sleeves.

60. The apparatus of claim 58 wherein said grouting control valve system further comprises:

second bypass valve means to bypass said flow of grouting material around said grouting valve means to a second annulus formed between a second pile sleeve and pile driven therethrough of said plurality of pile sleeves.

61. The apparatus of claim 58 wherein said grouting control valve system further comprises:

grout control check valve means to control said flow of grouting material from said annuli.

62. The apparatus of claim 58 wherein said grouting control valve system further comprises:

pipe tee and plug means to allow grouting material to be supplied to said annuli.

63. The apparatus of claim 52 wherein said grouting valve means comprises a pressure actuated grouting valve means to selectively control said flow of grouting material to said annuli by selectively controlling the initial pressure of said flow of grouting material to said annuli.

64. An inflation control valve system and a grouting control valve system for controlling the pressure and flow of inflation fluid during the inflation of lower inflatable packers installed on a plurality of jacket legs of an offshore platform and for controlling the pressure and flow of grouting material during the grouting of the annuli formed between said plurality of jacket legs and piles driven therethrough, wherein said inflation control valve system comprises:

lower packer inflation control valve means controlling the pressure at which said inflation fluid initially flows into said lower inflatable packers, and lower packer inflation check valve means connected to said lower packer inflation control valve means preventing said flow of inflation fluid from said lower inflatable packers after the inflation thereof; and wherein said grouting control valve system comprises:

grouting valve means to selectively control said flow of grouting material to said annuli.

65. The apparatus of claim 64 wherein said inflation control valve system further comprises:

lower packer inflation check valve means connected to said lower packer inflation control valve means preventing said flow of inflation fluid from said lower inflatable packers after the inflation thereof.

66. The apparatus of claim 64 wherein said grouting valve means comprises a sliding sleeve type valve means to selectively control said flow of grouting material to said annuli.

67. The apparatus of claim 64 wherein said grouting valve means comprises a pressure actuated grouting valve means to selectively control said flow of grouting material to said annuli by selectively controlling the initial pressure of said flow of grouting material to said annuli.

68. An inflation control valve system and a grouting control valve system for controlling the pressure and flow of inflation fluid during the inflation of lower inflatable packers installed on a plurality of jacket legs of an offshore platform and for controlling the pressure and flow of grouting material during the grouting of the annuli formed between a jacket leg and a pile driven therethrough of said offshore platform, said inflation control valve system utilizing a single inflation line from the surface of said offshore platform to supply said inflation fluid to said lower inflatable packers installed on said plurality of jacket legs and said grouting control valve system utilizing a single line from the surface of said offshore platform to supply said grouting material to said annuli, wherein said inflation control valve system comprises:

lower packer inflation control valve means controlling the pressure at which said inflation fluid initially flows into said lower inflatable packers; and lower packer inflation check valve means connected to said lower packer inflation control valve means preventing said flow of inflation fluid from said lower inflatable packers after the inflation thereof; and wherein said grouting control valve system comprises:

grouting valve means to selectively control said flow of grouting material to said annuli.

69. The apparatus of claim 68 wherein said inflation control valve system further comprises:

lower packer inflation check valve means connected to said lower packer inflation control valve means preventing said flow of inflation fluid from said lower inflatable packers after the inflation thereof.

70. The apparatus of claim 68 wherein said grouting valve means comprises a sliding sleeve type valve means to selectively control said flow of grouting material to said annuli.

71. The apparatus of claim 68 wherein said grouting valve means comprises a pressure actuated grouting valve means to selectively control said flow of grouting material to said annuli by selectively controlling the initial pressure of said flow of grouting material to said annuli.

* * * * *

UNITED STATES PATENT AND TRADEMARK OFFICE

CERTIFICATE OF CORRECTION

PATENT NO. : 4,275,974

DATED : June 30, 1981

INVENTOR(S) : Lloyd C. Knox and Bob L. Sullaway

It is certified that error appears in the above-identified patent and that said Letters Patent are hereby corrected as shown below:

In column 5, line 18, delete "a" and insert therfor --an--. In column 23, line 64, delete "intalled" and insert therefor --installed--. In column 24, line 22, delete "install" and insert therefor --installed--. In column 25, line 63, delete "let" and insert therefor --leg--.

Signed and Sealed this

*Twenty-second* Day of *September 1981*

[SEAL]

*Attest:*

GERALD J. MOSSINGHOFF

*Attesting Officer*

*Commissioner of Patents and Trademarks*

REEXAMINATION CERTIFICATE (594th)

United States Patent [19]

Knox et al.

[11] B1 4,275,974

[45] Certificate Issued Nov. 25, 1986

[54] INFLATION AND GROUT SYSTEM

[75] Inventors: Lloyd C. Knox; Bob L. Sullaway, both of Duncan, Okla.

[73] Assignee: Halliburton Company, Duncan, Okla.

Reexamination Request:
No. 90/000,942, Jan. 23, 1986

Reexamination Certificate for:

| | |
|---|---|
| Patent No.: | **4,275,974** |
| Issued: | **Jun. 30, 1981** |
| Appl. No.: | **12,674** |
| Filed: | **Feb. 15, 1979** |

[51] Int. Cl.[4] ..... E02B 17/00
[52] U.S. Cl. ..... 405/225; 405/227
[58] Field of Search ..... 405/224–227, 405/195

[56] References Cited

U.S. PATENT DOCUMENTS

| | | | |
|---|---|---|---|
| 2,934,804 | 5/1960 | Suderow | 24/263 |
| 3,564,856 | 2/1971 | Blount et al. | 405/225 |
| 4,009,581 | 3/1977 | Britton et al. | 405/227 |
| 4,063,427 | 12/1977 | Hoffman | 405/225 |
| 4,140,426 | 2/1979 | Knox | 405/225 |
| 4,214,843 | 7/1980 | Rohde | 405/225 |

OTHER PUBLICATIONS

Halliburton Services brochure, "Advanced Materials and Techniques Make Halliburton Your Best Choice for Offshore Platform Grouting", copyright 1978.

Article, "Grouting the Ninian Central Platform's Underbase", from Ground Engineering, pp. 17–22 (Nov. 1978).

Kennedy, J. G., Sverdvik, T., Domone, P. L., and Adams, M. A. J., "Foundation Grouting of Concrete Gravity Structures", from 1978 European Offshore Petroleum Conference and Exhibition, 1978 Proceedings vol. 1, pp. 131 to 135.

*Primary Examiner*—Dennis L. Taylor

[57] ABSTRACT

A system for inflating packers installed in offshore platforms and grouting the annuli between the piles and either the jacket legs and/or pile sleeves utilizing a separate inflation line system for the packers and a separate grouting line system for grouting the annuli.

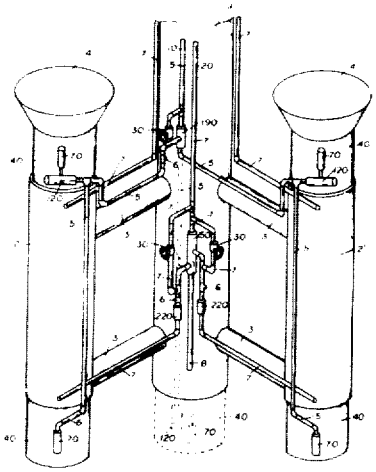

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–71 is confirmed.

* * * * *